US011142438B2

(12) United States Patent
Benton et al.

(10) Patent No.: US 11,142,438 B2
(45) Date of Patent: Oct. 12, 2021

(54) GRAPHICAL WORKING RANGE DIAGRAMS FOR DISPLAYING ALLOWABLE AND PROJECTED LOADS

(71) Applicant: Manitowoc Crane Companies, LLC, Manitowoc, WI (US)

(72) Inventors: John F. Benton, Smithsburg, MD (US); John R. Rudy, Greencastle, PA (US)

(73) Assignee: MANITOWOC CRANE COMPANIES, LLC, Milwaukee, WI (US)

( * ) Notice: Subject to any disclaimer, the term of this patent is extended or adjusted under 35 U.S.C. 154(b) by 0 days.

(21) Appl. No.: 16/114,983

(22) Filed: Aug. 28, 2018

(65) Prior Publication Data

US 2019/0062130 A1 Feb. 28, 2019

Related U.S. Application Data

(60) Provisional application No. 62/550,962, filed on Aug. 28, 2017, provisional application No. 62/550,921, filed on Aug. 28, 2017.

(51) Int. Cl.

| | |
|---|---|
| ***B66C 23/90*** | (2006.01) |
| ***B66C 13/18*** | (2006.01) |
| ***B66C 13/16*** | (2006.01) |

(52) U.S. Cl.

CPC ..... *B66C 23/905* (2013.01); *B66C 13/16* (2013.01); *B66C 13/18* (2013.01)

(58) Field of Classification Search

CPC ..... B66C 23/905; B66C 13/16; B66C 13/18

See application file for complete search history.

(56) References Cited

U.S. PATENT DOCUMENTS

| | | | |
|---|---|---|---|
| 5,730,305 | A | 3/1998 | Ichiba et al. |
| 7,395,940 | B2 | 7/2008 | Liebherr et al. |
| 7,665,620 | B2 | 2/2010 | Liebherr |
| 8,275,591 | B2 | 9/2012 | Huebler |
| 8,334,687 | B2 | 12/2012 | Ma et al. |
| 9,505,591 | B2 | 11/2016 | Morath et al. |

(Continued)

FOREIGN PATENT DOCUMENTS

| | | | |
|---|---|---|---|
| DE | 19933917 | A1 | 2/2000 |
| DE | 202010014310 | U1 | 1/2012 |

(Continued)

OTHER PUBLICATIONS

Extended European Search Report issued by EPO in connection with EP18191227 dated Apr. 5, 2019.

(Continued)

*Primary Examiner* — Navid Ziaeianmehdizadeh

(74) *Attorney, Agent, or Firm* — Klintworth & Rozenblat IP LLP

(57) ABSTRACT

A working range diagram for a crane includes a boom model representing a current boom length and current lift angle. The working range diagram also includes a plurality of zones based on limit radii corresponding to different predetermined load utilizations. Each zone of the one or more zones represents a radial distance. The working range diagram further includes a load model representing a current load radius positioned relative to the one or more zones. A crane control system may generate the working range diagram.

14 Claims, 13 Drawing Sheets

(56) References Cited

U.S. PATENT DOCUMENTS

| | | | | |
|---|---|---|---|---|
| 10,144,621 | B2 | 12/2018 | Braun et al. | |
| 10,410,124 | B1 * | 9/2019 | Zhou | G06N 5/04 |
| 2003/0090384 | A1 * | 5/2003 | Nishimura | E02F 3/962 340/685 |
| 2012/0101694 | A1 | 4/2012 | Morath et al. | |
| 2012/0160916 | A1 | 6/2012 | Galm et al. | |
| 2012/0326885 | A1 | 12/2012 | Mccarty | |
| 2014/0035923 | A1 | 2/2014 | Oshima et al. | |
| 2015/0210513 | A1 | 7/2015 | Mayr et al. | |
| 2016/0318739 | A1 * | 11/2016 | Terata | B66C 15/065 |
| 2017/0036894 | A1 | 2/2017 | Braun et al. | |

FOREIGN PATENT DOCUMENTS

| | | | |
|---|---|---|---|
| DE | 102011115224 | A1 | 4/2012 |
| DE | 102011115240 | A1 | 4/2012 |
| EP | 0779237 | A2 | 6/1997 |
| EP | 1772415 | A2 | 4/2007 |
| EP | 2909127 | A1 | 8/2015 |
| JP | 03130291 | U1 | 12/1991 |
| JP | H09328296 | A | 12/1997 |
| JP | 2002250055 | A | 9/2002 |
| JP | 2003300690 | A | 10/2003 |
| JP | 2004075206 | A | 3/2004 |
| JP | 2005001847 | A | 1/2005 |
| JP | 2005219932 | A | 8/2005 |
| JP | 2007008638 | A | 1/2007 |
| JP | 2008265934 | A | 11/2008 |
| JP | 2013052991 | A | 3/2013 |
| JP | 2015030588 | A | 2/2015 |
| WO | 2017023735 | A1 | 2/2017 |

OTHER PUBLICATIONS

Extended European Search Report issued by EPO in connection with EP18000998 dated Apr. 24, 2019.

* cited by examiner

GRAPHICAL WORKING RANGE DIAGRAMS FOR DISPLAYING ALLOWABLE AND PROJECTED LOADS

BACKGROUND

The present disclosure relates to a crane control system, a graphical working range diagram generated by the crane control system and a method of generating the working range diagram.

Mobile cranes typically include a carrier unit in the form of a transport chassis and a superstructure unit having a boom for lifting objects. The superstructure unit is typically rotatable upon the carrier unit. During transport the crane is supported by the carrier unit on its axles and tires.

Rated capacity limiter (RCL) systems have been developed to monitor the load the crane is lifting and alert the operator of operating conditions. Traditional RCL systems may be as simple as an indicator or audible alarm that sounds if a threshold is reached. For example, if the crane attempts to lift beyond a certain capacity, the alarm will sound. More recently, monitoring systems monitor the geometry of the crane and can alert the operator if the crane is moving into a restricted operating condition. For example, a crane may have a constant load on the hook, but as it lowers the boom angle, the load moment increases and may move the crane into a restricted or unstable condition. RCL systems may detect the change in boom angle and the resulting increase in load moment, and alert the operator.

RCL systems typically include information referred to as load charts which indicate the maximum permissible load to lift depending on the crane configuration. One of the configuration characteristics is the positioning of the outriggers. Typically, there are four outriggers in a nearly square arrangement and the load charts only consider that the outriggers are extended from the vehicle at 0%, 50%, or 100%. Furthermore, the load charts typically assume that all outriggers are extended to the same extent. Because the center-line of rotation is at approximately a mid-point between the outriggers, the load chart can be assumed to be a "360 chart" since the minimum permissible load does not change with a swing, or slew, angle.

In some situations, a mobile crane may not have a symmetric capacity, either as a design or the result of outriggers being extended in varying lengths. The permissible load then becomes dependent on the slew angle. A cautious approach would be to select a load chart based on the minimum outrigger extension. This will provide a permissible operating condition regardless of the slew angle. However, such a system would operate below the actual capacity of the crane. Alternatively, a load chart could be selected based on the position of the outriggers between the superstructure and the load. This would maximize the lifting capacity of the crane, but would require careful monitoring to ensure that the system did not do any lifting outside of a limited area.

Currently, if an operator desires to know a load limit, the operator typically uses a load chart for the current crane configuration. The current crane configuration may take into account, for example, the outrigger configuration, slew angle, lift angle, boom extension length and load radius, which is dependent on the lift angle and boom extension length. On the load chart, the operator may identify a load that corresponds to the current boom extension length and current load radius. This load is the current load limit, or maximum load, for the current crane configuration. A given load, such as the current, measured load, or a desired load to be lifted, may then be compared to the current load limit. If the current load is less than the current load limit, then crane operation is permitted by a crane control system. If the current load is equal to or greater than the current load limit, the crane control system prevents crane movements that would further decrease the load limit. If the crane is asymmetric with varying capacities depending on a slew angle, this process may be repeated for each direction or slew sector (i.e., slew angle range).

The amount of information available to an operator may be overwhelming. For example, desired crane operation may be dependent on not only the load being lifted, but on the horizontal (radial) distance of the load to the center of gravity of the crane (i.e., the load radius), and the slew angle. The load chart information described above may be difficult to analyze during a lifting operation which may lead to slower operations or operating errors.

U. S. Pat. App. Pub. No. 2017/0036894 to Braun et al. proposes a system which generates a graphical representation showing a top view (i.e., a view of a horizontal plane) of the boom and working range limits across a slew angle range. In Braun et al., an angular range is displayed with an indication of a load position. The display further includes a first load range in which the suspended load is significantly smaller than the maximum permissible load, a second load range in which the suspended load approximately corresponds to the maximum permissible load, and a third range in which the suspended load is equal to or more than the maximum permissible load. A control unit calculates corresponding maximum permissible loads for each current load position and for positions of the boom corresponding to the possible load positions that surround the current load position. This portion is displayed in a segmented presentation depending on a position by flat visual design. This allows the crane operator to realize what distance is between the current load position and a boundary defined by the maximum permissible loads.

U. S. Patent Application Publication No. 2014/0035923 to Oshima et al. relates to another system for visualizing a working range. Oshima et al. provides a working range diagram in which a boom can safely move with a three-dimensional spatial coordinate system. Working range conditions can be input and/or stored, and a working range calculation means may calculate the working range. Three-dimensional data of the working range diagram is output to a display after a visual field conversion.

However, the above systems may not provide sufficient or readily identifiable visual information to the crane operator to inform the crane operator of load radius (working range) limits in the current slew sector and adjacent slew sectors. In addition, the systems above may require relatively large amounts of computer processing resources.

Accordingly, it is desirable to provide a graphical working range diagram showing limit radii for different load utilizations to allow a crane operator to quickly determine a current load radius with respect to the limit radii.

SUMMARY

According to one aspect, there is provided a crane control system configured to generate a working range diagram for a crane. The crane control system includes a memory configured to store program instructions and a processor configured to execute the program instructions to determine one or more limit radii of a crane by calculating a maximum allowed load for a predetermined load utilization based on the current load, identify the calculated maximum allowed load in a stored load chart, retrieve a load radius from the stored load chart which corresponds to the calculated maximum allowed load, and designate the load radius as a limit radius corresponding to the predetermined load utilization. The crane control system is further configured to generate a working range diagram. The working range diagram may include a boom model representing a current boom length and lift angle and one or more zones based on the one or more limit radii corresponding to respective predetermined load utilizations. Each zone of the one or more zones represents a radial distance corresponding to a range of load utilization. The working range diagram further includes an indication of a current load radius.

In one embodiment, the working range diagram may further include a circular segment based on the boom length rotated through a range of lift angles. The one or more zones may be formed within the circular segment and the boom model is superimposed on the circular segment. In addition, the indication of the current load radius may include a load model superimposed on the circular segment and positioned relative to the one or more zones.

In one embodiment, the working range diagram may further include a plurality of load chart sector models each representing a range of a slew angles. The one or more zones may be provided in each load chart sector model and the boom model may be superimposed on a load chart sector model representing the slew angle range in which a crane boom is currently positioned. The indication of the load radius may include a load model superimposed on the load chart sector model representing the slew angle range in which the crane boom is currently positioned and positioned relative to the one or more zones. The plurality of load chart sector models may represent a portion of an entire slew range of the crane, and the working range diagram further may further include an indication of the one or more limit radii over the entire slew range.

According to another aspect, a working range diagram for a crane may include a boom model representing a current boom length and lift angle and a plurality of zones based on limit radii corresponding to different predetermined load utilization. Each zone of the one or more zones represents a radial distance. The working range diagram further includes a load model representing a current load radius positioned relative to the one or more zones.

According to another aspect, a method of generating a working range diagram for a crane includes storing information relating to detected or determined crane parameters, selecting a load chart based on the current crane configuration and the current slew angle, retrieving a maximum allowed load from the load chart, receiving one or more predetermined load utilizations based on the current load, determining a limit radius at the predetermined load utilizations, and generating a working range diagram. The working range diagram includes a boom model representing a current boom length and lift angle, a plurality of zones based on the limit radii corresponding to different predetermined load utilizations, and a load model positioned relative to the zones representing a current load radius.

These and other features and advantages of the present invention will be apparent from the following detailed description, in conjunction with the appended claims.

DETAILED DESCRIPTION

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
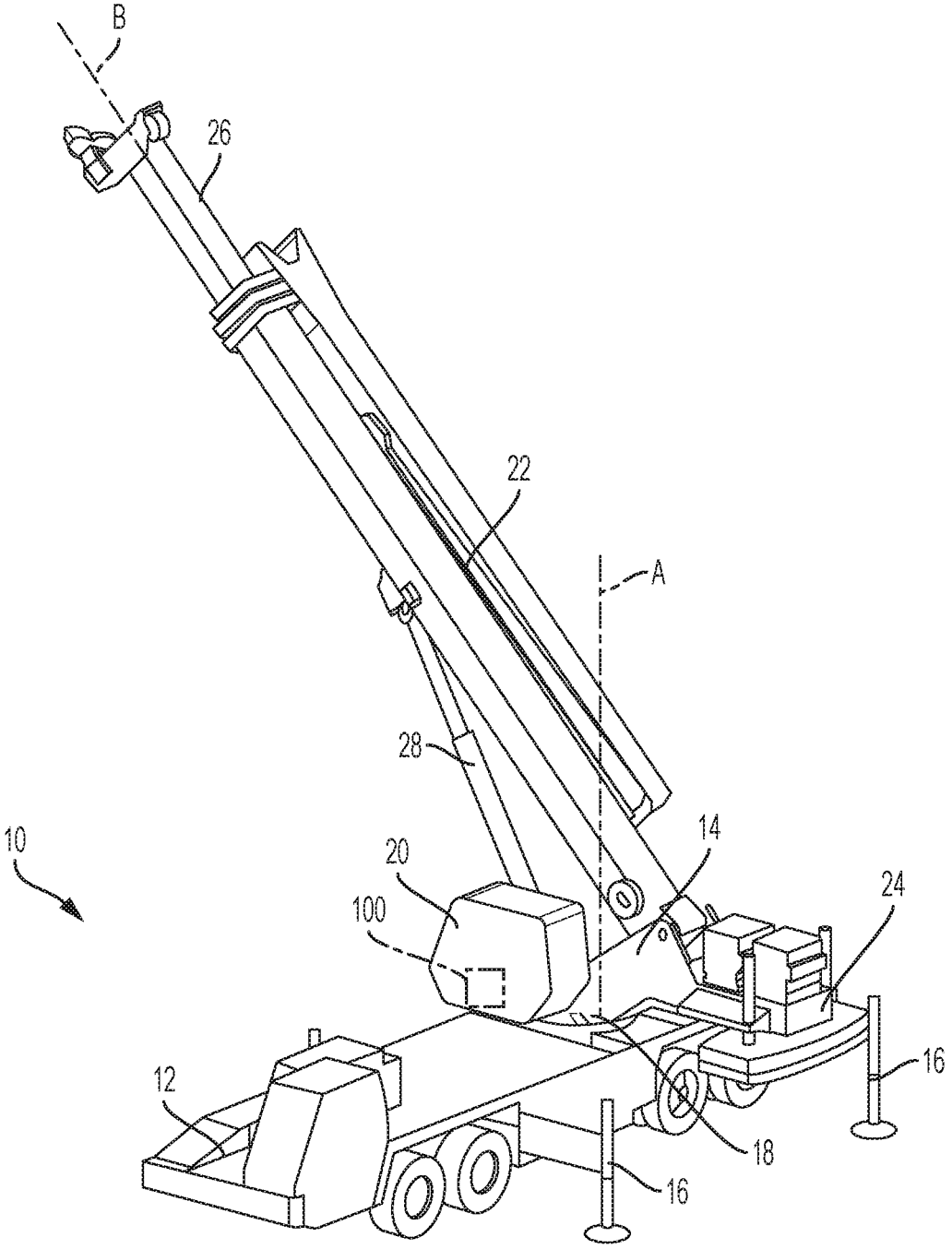
FIG. 1 is a perspective view of a crane according to an embodiment.

FIG. 1 is a perspective view of a crane 10 according an embodiment described herein. The crane 10 includes a carrier 12 for engagement with the ground and a superstructure 14 mounted on the carrier 12. In one embodiment, the carrier 12 includes a plurality of extendable outriggers 16 configured to engage the ground or other surface to support the crane 10 during a lifting operation.

The superstructure 14 is rotatably mounted to the carrier 12 by a rotating bed 18 and is configured to rotate relative to the carrier 12 on an axis 'A'. The superstructure 14 includes, for example, an operator cab 20, a boom 22 and a counterweight 24, connected to the rotating bed 18. In one embodiment, the boom 22 is a telescoping boom having one or more telescoping portions 26 which are movable to extend or retract a length of the boom 22 generally along a boom axis 'B'. A lift cylinder 28 is operably connected between the boom 22 and the rotating bed 18 and is operated to move the boom 22 through a range of lift angles.

The crane 10 further includes a crane control system 100. FIG. 1 shows the crane control system 100 schematically positioned in the operator cab 20. However, it is understood that the crane control system 100 is not limited to such a location. For example, the crane control system 100 may include components at different locations of the crane 10, remote from the crane, or both, that are operably and communicatively connected to other another.

Figure 2:
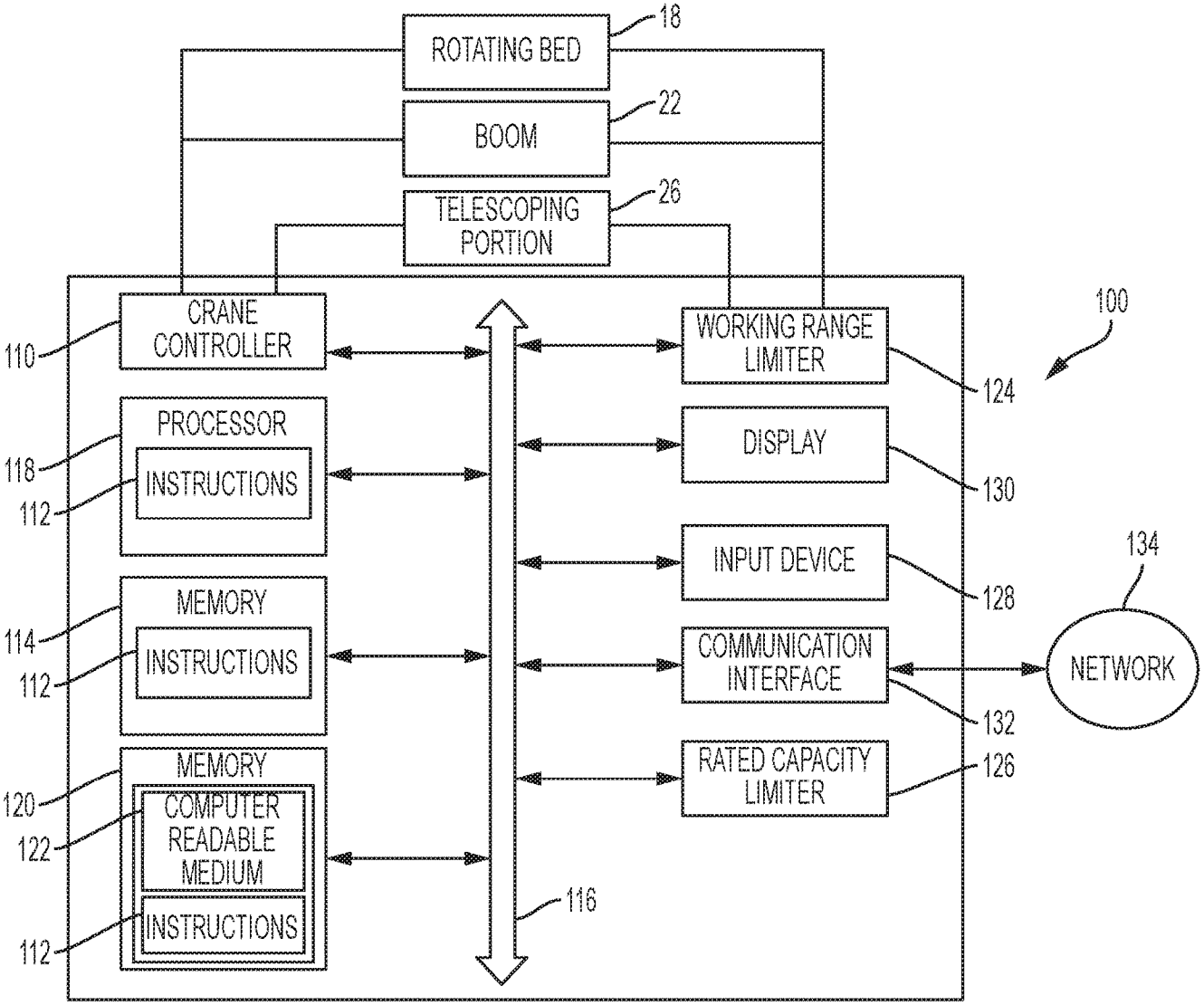
FIG. 2 is a block diagram of a crane control system according to an embodiment.

FIG. 2 is a schematic block diagram of the crane control system 100, according to an embodiment. In one embodiment, the crane control system 100 includes one or more crane controllers 110 operably connected to one or corresponding crane components, such as the rotating bed 18, the boom 22 or the telescoping portion 26 of the boom 22, to control operations of the one or more crane components, including controlling or preventing movements of the one or more crane components. In one embodiment, controls (not shown) may be disposed in the operating cab 20. An operator may manipulate the controls to produce an input signal, received at the crane control system 100, which causes the crane controller 110 to operate the one or more crane components based on the input signal.

In one embodiment, the crane control system 100 may generally represent a cab computing device, a wireless network computer, or any other computing device referenced herein or that may be used to execute the disclosed methods or logic disclosed. The crane control system 100 may include an ordered listing or a set of program instructions 112 that may be executed to cause the crane control system 100 to perform any one or more of the methods or computer-based functions disclosed herein. The crane control system 100 may operate as a stand-alone device or may be connected, e.g., using a network, to other computer systems or peripheral devices, for example.

In a networked deployment, the crane control system 100 may operate in the capacity of a server or as a client-user computer in a server-client user network environment, or as a peer computer system in a peer-to-peer (or distributed) network environment. The crane control system 100 may also be implemented as or incorporated into various devices, such as a personal computer or a mobile computing device capable of executing program instructions 112 that specify actions to be taken by that machine, including and not limited to, execution of certain applications, programs, and with the option of accessing the Internet or Web through any form of browser. Further, each of the systems described may include any collection of sub-systems that individually or jointly execute a set, or multiple sets, of instructions to perform one or more computer functions.

The crane control system 100 may include a memory 114 on a bus 116 for communicating information. Code (i.e., program instructions 112) operable to cause the crane control system to perform or cease performance of any of the acts or operations described herein may be stored in the memory 114. The memory 114 is a computer-readable storage medium, such as, but not limited to, random-access memory, read-only memory, programmable memory, hard disk drive or any other type of volatile or non-volatile memory or storage device.

The crane control system 100 may include a processor 118, such as a central processing unit (CPU) and/or a graphics-processing unit (GPU). The processor 118 may include one or more general processors, digital signal processors, application specific integrated circuits, field programmable gate arrays, digital circuits, optical circuits, analog circuits, combinations thereof, or other now known or later-developed devices for analyzing and processing data. The processor 118 may implement the set of program instructions 112 or other software program, such as manually programmed or computer-generated code for implementing logical functions. The logical function or any system element described may, among other functions, process and/or convert an analog data source such as an analog electrical, audio, or video signal, or a combination thereof, to a digital data source for audio-visual purposes or other digital processing purposes such as for compatibility of computer processing.

The crane control system 100 may also include a memory implemented as a disk or optical drive unit 120. The disk drive unit 122 may include a computer-readable medium 122 in which one or more sets of instructions 112, e.g., software, can be embedded. Further, the instructions 112 may perform one or more of the operations as described herein. The instructions 112 may reside completely, or at least partially, within the memory 114 and/or within the processor 118 during execution by the crane control system 100. One or more databases in memory may store load chart data.

The memory 114 and the processor 118 also may include computer-readable media as discussed above. A "computer-readable medium," "computer-readable storage medium," "machine readable medium," "propagated-signal medium," and/or "signal-bearing medium" may include any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium.

The crane control system 100 may further include a working range limiter 124, and a rated capacity limiter (RCL) 126. The crane controller 110 may be coupled with the processor 118 and the bus 116 and be configured to control components of the crane, including the boom 22 and the rotating bed 18, in response to receiving control signals from the processor 118.

The RCL 126 (also referred to as a moment limiter in the art) provides information for crane operators regarding operating parameters within which crane components may work. The working range limiter 124 provides information for crane operators to relating to a working range in which the crane 10 may be operated as desired. The working range limiter 124 and the RCL 126 may each monitor the operations of the crane 10 through a plurality of sensors (not shown), and provide information regarding the limits of the crane 10 to an operator. In some embodiments the functionality of the working range limiter 124 and the RCL 126 may be combined into a single unit.

The sensors are configured to detect parameters which may affect the working range of the crane 10 and output information representative of the detected parameters to the crane control system 100, for example to the processor 118 or memory 114. In one embodiment, the sensors may be integrated with the crane control system 100. For example, the sensors may be configured to detect a length of the boom 22, a lift angle $\theta$ of the boom 22, a slew angle $\alpha$, and a load of an object suspended from the boom 22 to be lifted. The crane control system 100 may determine additional parameters based on the detected parameters. For example, the crane control system 100 may determine a load radius, a maximum allowed load (i.e., a rated load), and a working range limit (i.e., a maximum load radius within which desired crane operations may be conducted with the current load). The maximum allowed load may be determined based on information stored in a load chart corresponding to the crane configuration and slew angle during the lifting operation. In one embodiment, within the load chart, the maximum allowed load may be determined based on the boom length and the load radius.

The detected and determined parameters may change continuously during a lifting operation. In one embodiment, if the crane 10 works near or beyond load capacity or range limits, the crane control system 100, for example, the working range limiter 124 and/or RCL 126, may sound an alarm, light an indicator, and/or modify the operation of the crane 10. In some embodiments, the working range limiter 124 may also be adapted to act as a controller of the boom 22, the telescoping portion 26, and/or the rotating bed 18. The sensors may provide information representing the detected information to the crane control system 100, for example, to the working range limiter 124, RCL 126 or other component of the crane control system 100, such as the memory 114 or 120.

Additionally, the crane control system 100 may include an input device 128, such as a keyboard, mouse, joystick, touchscreen, keypad, dial, lever or the like configured for a user to interact with any of the components of the crane control system 100. The crane control system 100 may further include a display 130, such as a liquid crystal display (LCD), a cathode ray tube (CRT), Light Emitted Diode (LED) display, Organic Light Emitting Diode (OLED) display, or any other display suitable for conveying information. The display 130 may act as an interface for the operator to see the functioning of the processor 118, or specifically as an interface with the software stored in the memory 114 or the drive unit 120.

The crane control system 100 may include a communication interface 132 that enables communications via the communications network 134. The network 134 may include wired networks, wireless networks, or combinations thereof. The communication interface 132 and network 134 may enable communications via any number of communication standards, such as 802.11, 802.17, 802.20, WiMax, cellular telephone standards, or other communication standards including wired communications.

Accordingly, the methods and systems described herein may be realized in hardware, software, or a combination of hardware and software. The methods and systems may be realized in a centralized fashion in at least one computer system or in a distributed fashion where different elements are spread across several interconnected computer systems. A typical combination of hardware and software may be a general-purpose computer system with a computer program that, when being loaded and executed, controls the computer system such that it carries out the methods described herein. Such a programmed computer may be considered a special-purpose computer, and be specially adapted for placement within the operator cab 20 and control of the crane 10.

The methods and systems may also be embedded in a computer program product, which includes all the features enabling the implementation of the operations described herein and which, when loaded in a computer system, is able to carry out these operations. Computer program in the present context means any expression, in any language, code or notation, of a set of instructions intended to cause a system having an information processing capability to perform or cease performance of a particular function, either directly or after either or both of the following: a) conversion to another language, code or notation; b) reproduction in a different material form.

The order of the steps or actions of the methods described in connection with the disclosed embodiments may be changed as would be apparent to those skilled in the art. Thus, any order appearing in the Figures or described with reference to the Figures or in the Detailed Description is for illustrative purposes only and is not meant to imply a required order, except where explicitly required.

Figure 3:
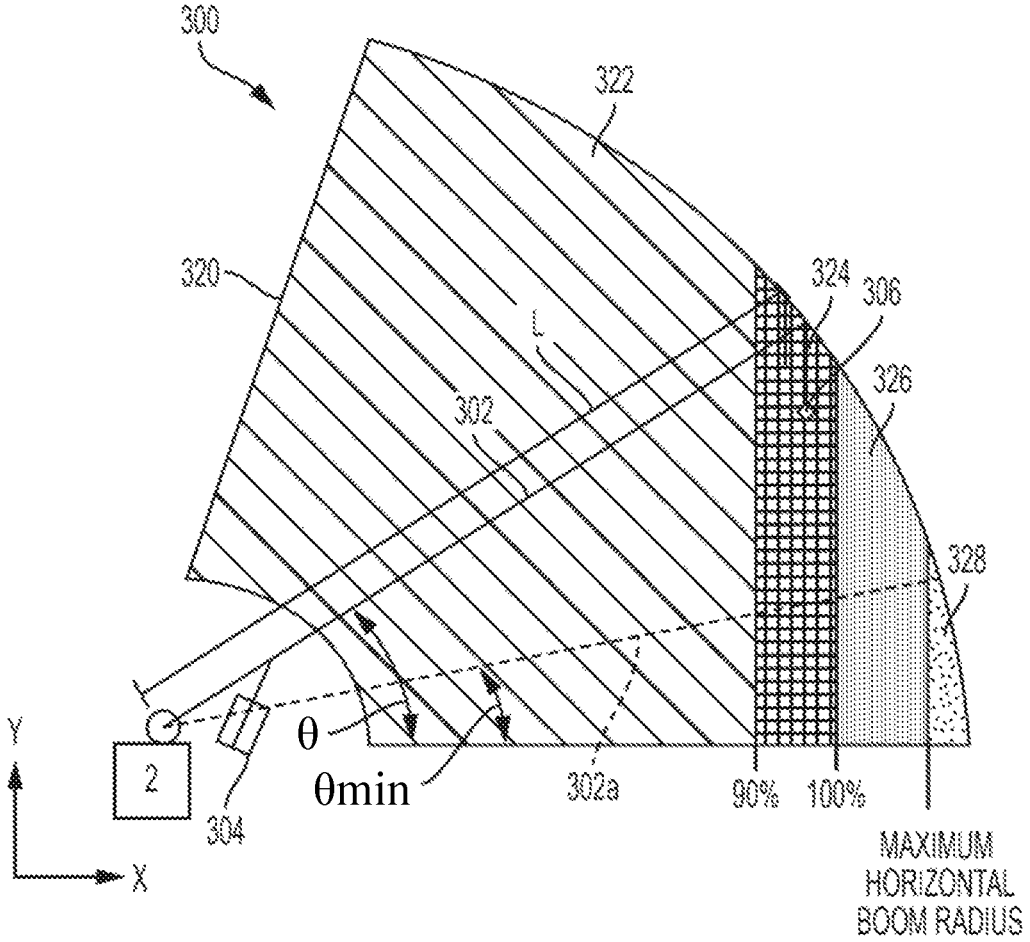
FIG. 3 illustrates a first working range diagram according to an embodiment.

FIG. 3 illustrates an embodiment of a first working range diagram 300. In one embodiment, the first working range diagram 300 graphically represents a side view of the crane 10 at a current slew angle. Accordingly, the first working range diagram 300 includes a horizontal axis 'X' corresponding to a radial direction along which a load radius and/or one or more limit radii may be indicated, and a vertical axis 'Y' corresponding to a vertical direction.

The first working range diagram 300 includes a graphical representation of the boom 22, referred to herein as the boom model 302. The first working range diagram 300 may optionally include graphical representations of one or more additional crane components, such as, but not limited to, the lift cylinder 28, referred to herein as the lift cylinder model 304, and an object to be lifted (not shown) suspended from the boom 22, referred to herein as the load model 306. The load model 306 may also represent a current load radius of the object being lifted, as described further below.

In the first working range diagram 300, graphical representations of various crane components, including the boom 22, lift cylinder 28 and the load, may be scaled depictions of the actual crane components, such as scaled images, computer generated images, representative designs or schematic representations of the crane components. The scaled depictions may be stored, for example, in the memory 114 of the crane control system 100. In addition, the graphical representations of the crane components may be based on the information received from the sensors, such as information relating to the boom length and/or lift angle θ. For example, the boom model 302 may be oriented in the first working range diagram 300 at a lift angle θ corresponding to information based on a lift angle detected by the one or more sensors, and having a length corresponding to information based on a boom length detected by the one or more sensors.

Other information provided by the one or more sensors may include, for example, telescoping boom section positions and/or extension, the slew angle, load radius, tip height and current load. In one embodiment, as an alternative, one or more of the parameters described above as being detected by the sensors may be calculated by the crane control system 100 based on information received from the one or more sensors, or may be manually input to the crane control system 100 by an operator.

In the first working range diagram 300, the graphical representations of the one or more crane components may be based, in part, on substantially real-time or live information received from the sensors, and the first working range diagram 300 may be updated to reflect to a change in information received from the one or more sensors.

The first working range diagram 300 includes a circular segment 320 that corresponds to the current reach of the boom 22, i.e., the boom length, rotated through a range of lift angles θ. The boom model 302 may be superimposed on the circular segment 320.

Load charts may be stored, for example, in the memory 114, and may be accessed by the RCL 126. Different load charts are provided different crane configurations. Different crane configurations may be provided, for example, by varying a counterweight 24 configuration, outrigger 16 configurations (e.g., extension length, symmetric extension, asymmetric extension, etc.;), boom configuration, maximum slew range or combinations thereof. In addition, load charts may be provided based on a slew angle of the boom 22, since a maximum allowed load at a load radius may vary across the slew range of the crane 10.

The RCL 126 may be configured to select a current load chart based on the current configuration and the current slew angle. The current crane configuration may be determined, for example, based on the parameters detected by the sensors or input by an operator. Similarly, the current slew angle may be detected by the sensors or input by an operator. The RCL 126 may then determine the maximum allowed load based on a load radius and a boom length from the load chart.

In one embodiment, the boom length and the current load may be known, for example, based on the parameters detected by the sensors, calculations performed by the crane control system 100, or operator input. Accordingly, the crane control system 100 may then determine a ratio of the current load to the maximum allowed load at the current load radius. This ratio is referred to as the "load utilization" and may be expressed as a percentage.

According to embodiments herein, the crane control system 100 may also determine a load radius at which a predetermined load utilization may be reached, i.e., a limit radius corresponding to a predetermined load utilization value. For example, the crane control system 100 may determine a limit radius corresponding to 90% load utilization, or in another example, a limit radius corresponding to 100% load utilization. In one embodiment, a limit radius may also be determined a maximum no-load horizontal reach of the boom 22, at a minimum lift angle θ, may be determined as well. In the embodiments described herein, a limit radius refers to a radius within the working range corresponding to a predetermined load utilization. Such a limit radius may also be referred to herein as a working range limit. In some embodiments, the limit radius may additionally refer to a radius outside of the working range, the identification of which may be useful to the operator, such as the maximum no-load horizontal reach of the boom 22 at a the minimum lift angle. Such a limit radius may be referred to herein as overload radii. The working range refers to a range of load radii where the load utilization is less than 100%, or possibly, equal to or less than 100%.

The current load is expected to remain constant during a lifting operation. However, the maximum allowed load, derived from one or more load charts, may vary with load radius during a lifting operation. For example, the maximum allowed load may decrease as the load radius increases. Conversely, the maximum allowed load may increase as the load radius decreases. As such, the load utilization may change with changes in load radius.

In addition, the maximum allowed load may change based on the slew angle. For example, as discussed above, different load charts may be provided for different slew angles or different slew angle ranges. Thus, the maximum allowed load, and consequently, the load utilization, may change in response to slewing movement of the boom 22 to a slew angle α at which a new load chart is selected. A slew angle range for which a single load chart is used, in the current crane configuration, may be referred to herein as a load chart sector.

Accordingly, in an embodiment of the present application, a limit radius corresponding to a predetermined load utilization, may be determined based on, for example, the current load, a current load chart selected based on the slew angle α and the crane configuration, the boom length and the lift angle θ. Generally, the limit radius corresponding to a predetermined load utilization may be determined by multiplying the current load by an adjustment factor corresponding to the predetermined load utilization to determine an adjusted maximum allowed load. The adjusted maximum allowed load may then be found on the current load chart, for example, by moving along a column having maximum allowed loads for the current boom length, at different lift angles or different load radii. The load radius associated with the adjusted maximum load may then be used as the limit radius for the predetermined load utilization.

In some cases, the adjusted maximum load, and thus, the corresponding load radius, may not be provided on the load chart, for example, because they fall between or outside of the known information on the load chart. Accordingly, in one embodiment, the adjusted maximum load may be rounded to a nearest maximum allowed load provided on the load chart based on predetermined criteria, and the load radius corresponding to the nearest maximum allowed load may be used as the limit radius.

For example, to determine the limit radius corresponding to 100% load utilization, i.e., the load radius where the current load is equal to the maximum allowable load, the current load may be multiplied by an adjustment factor of 1.0 to obtain the adjusted maximum allowed load. The adjusted maximum allowed load may then be looked up on the current load chart based on, for example, the current boom length, and a load radius corresponding to the adjusted maximum allowed load may be found. This corresponding load radius may then be used by the crane control system 100 as the limit radius corresponding to 100% load utilization.

In another example, to determine the limit radius corresponding to 90% load utilization, the current load may be multiplied by an adjustment factor 1.11 (i.e., 1/0.9) to obtain the adjusted maximum allowed load. The adjusted maximum allowed load may then be looked up on the load chart, and a load radius corresponding to the adjusted maximum allowed load may be found. This corresponding load radius may then be used by the crane control system 100 as the limit radius corresponding to 90% load utilization.

Corresponding load radii for any number of predetermined load utilizations, different from those described above, may be determined in a similar manner, using different adjustment factors corresponding to the different load utilizations. For example, to determine a limit radius corresponding to 75% load utilization, the current load may be multiplied by an adjustment factor of 1.33 (i.e., 1/0.75). For a limit radius corresponding to 80% load utilization, the current load may be multiplied by an adjustment factor of 1.25 (i.e., 1/0.80). It is understood that different load adjustment factors may be used to determine limit radii corresponding to different load utilizations, and that the present disclosure is not limited to the examples above.

In the embodiments above, the calculation of the adjusted maximum allowed load and looking up of, or otherwise determining, the corresponding load radius may be carried out by the crane control system 100, for example, using data from RCL 126 and/or WRL 124. The determined load radii corresponding to different load utilizations, e.g., 90%, 100%, may then be displayed in the first working range diagram 300, as described further below.

The first working range diagram 300 may also include one or more zones depicted in the circular segment 320, based on the limit radii. For example, in one embodiment, a zone may be depicted between limit radii corresponding to different load utilizations. In one embodiment, a zone may be defined along the X-axis between two limit radii correspond to different load utilizations, and extend along the Y-axis to a radially outer arc-shaped portion of the circular segment 320.

For example, an operator may wish to determine a limit radius where the current load is 90% of the maximum allowed load (i.e., a limit radius for 90% load utilization).

With a known current load and a predetermined load utilization (e.g., 90%) sought, the adjusted maximum allowed load may be determined as described above. The adjusted maximum allowed load may then be looked up on the current load chart corresponding to the current crane configuration and the current slew angle, and the load radius corresponding to the adjusted maximum allowed load may be determined from the load chart. Thus, the corresponding load radius determined from the load chart is a limit radius where the current load is 90% of the maximum allowed load (at that load radius). Similar calculations may be carried out to determine other limit radii corresponding to different load utilizations, and in turn, zone boundaries for additional zones may be defined based on the limit radii. One or more overload radii may be determined as well to define one or more overload zones.

Referring still to FIG. 3, in one embodiment, a first zone 322 of the circular segment 320 may be a zone where load utilization is less than 90%. Thus, in the first working range diagram 300, the first zone 322 extends in the horizontal, or radial, direction 'X' to a limit radius corresponding to 90% load utilization, i.e., a load radius where the current load is 90% of the maximum allowed load. A second zone 324 may be a zone where the load utilization is between 90% and 100%, and thus, may extend along the horizontal (radial) direction from a limit radius corresponding to 90% load utilization to a limit radius corresponding to 100% load utilization. A third zone 826 may be an overload zone, where load utilization exceeds 100%. Thus, the third zone 826 extends in the horizontal direction outward from a limit radius corresponding to 100% load utilization. In one embodiment, the crane control system 100 may prevent movement of the boom 22 into the third (overload) zone 326. In one embodiment, the third zone 326 may extend from a limit radius corresponding to 100% load utilization to a limit radius defined by the position of the boom tip when the boom 22 is unloaded and lowered to its minimum lift angle $\theta_{min}$.

FIG. 3 depicts the boom model 302 in the minimum lift angle position as a dashed lined labeled 302*a*. The minimum lift angle $\theta_{min}$ is typically greater than 0 degrees, thus the maximum horizontal extent of the boom 22 is less than the boom length. A fourth zone 328 may optionally be included in the first working range diagram 300, and extend horizontally beyond the maximum horizontal extent of the boom 22 to the radially outer an arc-shaped portion of the circular segment 320. The maximum horizontal extent for the boom 22 may be constant across all load chart (slew) sectors for a given length of the boom 22, unless the minimum lift angle varies with slew angle. The graphical representation 302*a* of the boom 22 in the minimum lift angle position is optionally, but not necessarily, depicted in first working range diagram 300.

In the embodiments above, the zones 322, 324, 326, 328 may be depicted in the first graphical display 300 with different colors, shadings, patterns, or the like, such that the different zones may be readily, visually identified by the operator. For example, the first zone 322 may be displayed having a green color or shading; the second zone 324 may be displayed having a yellow color or shading; the third zone 326 may be displayed having a red color or shading; and the fourth zone 328 may be shown having a black color or shading. It is understood, however, the present disclosure is not limited to the examples above. For example, boundaries for the zones, i.e., the limit radii, may be established at different load utilizations, a different number of zones may be depicted, and the zones may be depicted using different colors, shadings, patterns, or the like. In one embodiment, the limit radii may be graphically represented, for example, by vertical lines or similar markings.

Figure 4:
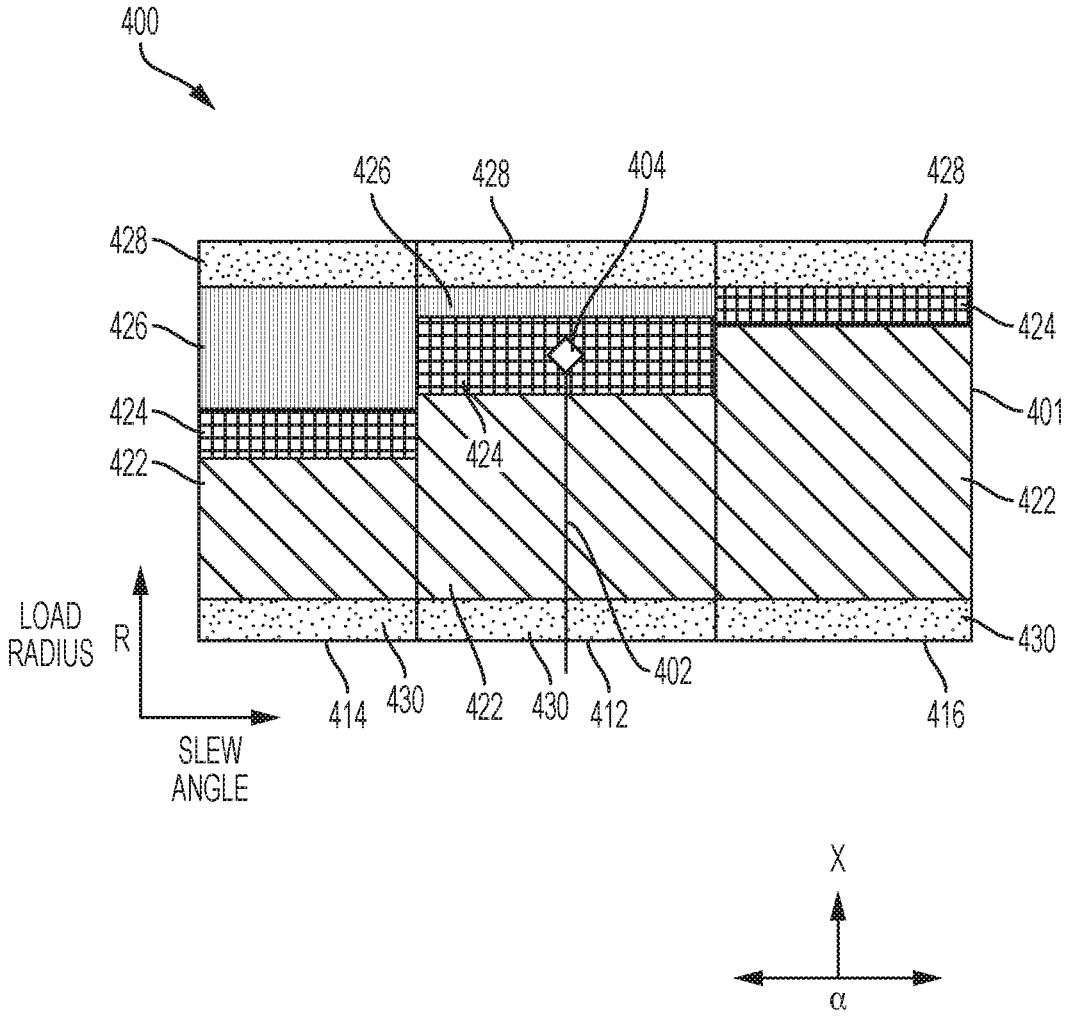
FIG. 4 illustrates a second working range diagram according an embodiment.

FIG. 4 illustrates an embodiment of a second working range diagram 400. In one embodiment, the second working range diagram 400 may be, for example, a scrolling diagram. That is, graphical representations of the second working diagram 400 may scroll, for example, horizontally or vertically within a boundary 401 of the diagram 400, as described further below.

In one embodiment, the second working range diagram 400 includes graphical representations of one or more load chart sectors, referred to herein as load chart sector models. Each load chart sector corresponds to a slew angle range of the crane 10. In one embodiment, the one or more load chart sector models include a current load chart sector model 412 corresponding to a load chart sector in which the boom 22 is currently positioned, a first adjacent load chart sector model 414 and a second adjacent load chart sector model 416, corresponding to load chart sectors adjacent to the current load chart sector.

Each of the one or more load chart sector models 412, 414, 416 may also include one or more zones based on the limit radii corresponding to different load utilizations as described above. For example, in one embodiment, the one or more zones of the second working range diagram 400 may generally correspond to the zones 322, 324, 326, 328 described in the embodiment above with reference to FIG. 3. Thus, in one embodiment, the second graphical display 400 may include a first zone 422 extending to a limit radius corresponding to 90% load utilization, a second zone 424 extending from the limit radius correspond to 90% load utilization to the limit radius to 100% load utilization, a third zone 426 extending outward from the limit radius correspond to 100% load utilization. In one embodiment, the third zone may extend to a distance corresponding to the position of the boom tip when the boom 22 is unloaded and lowered to its minimum lift angle $\theta_{min}$.

The second working range diagram 400 optionally includes a fourth zone 428 extending from the maximum horizontal extent of the boom 22 the boundary 401 of the second working diagram 400.

In one embodiment, the current load chart sector model 412 includes the first zone 422, the second zone 424, the third zone 426, and optionally, the fourth zone 428. Similarly, adjacent load chart sector models 414, 416 may display one or more of the zones 422, 424, 426, 428 as a function of load radius as well. However, as may be seen in the load chart sector models of the second working range diagram 400, the limit radii may vary in different load chart sectors.

In addition, the zones 422, 424, 426, 428 may be displayed having different coloring, shading, patterns, or the like, so that the zones may be more readily visually distinguished from one another. In one embodiment, such coloring, shading, patterns or the like may substantially correspond to those described above with respect to the embodiment in FIG. 3. However, it is understood that the present disclosure is not limited to these examples, and other colors, shading, patterns and the like may be used or associated with each zone. It is also understood that additional or fewer zones may be included and that the zones may correspond to different load utilizations and/or other radial distances as desired. In one embodiment, the second working range display 400 may also include a fifth zone 430 representing a load radius range less than a minimum working range limit, wherein load utilization exceeds 100% exceeds 100% in the fifth zone 430. Such a zone 430 may occur at relatively high lift angles.

Further still, it is understood that in some configurations, not all zones may be present. For example, in one embodiment, with reference to the second adjacent load chart sector model 416, the current load may be substantially low such that the boom 22 may extend to its maximum horizontal extent without entering the third, overload zone 426. Thus, the overload zone 426 may be omitted from that load chart sector model.

Additional indicators may be included with the second working range diagram 400, such as indicators including information relating to a current slew angle and a current load radius. Further, the second graphical display 400 may include a boom model 402 which may superimposed over the current load chart sector model 412. In addition, a load model 404 may be included as well. In one embodiment, the load model 404 may be positioned at a location in the current load chart sector model 412 representative of the current load radius.

In one embodiment, the second working range diagram 400 may include the current load chart sector model 412 at a generally central location, the first adjacent load chart sector model 414 to the left of the current load chart sector model 412, and the second adjacent load chart sector model 416 to the right of the current load chart sector model 412, wherein the first adjacent load chart sector model 414 corresponds to a load chart sector into which the crane 10 enters by slewing to the left, or counterclockwise, and the second adjacent load chart sector model 416 corresponds to a load chart sector into which the crane 10 enters by slewing to the right, or clockwise. In one embodiment, the load chart sector models 412, 414, 416 may be arranged generally along a horizontal direction of the diagram 400, which corresponds to the slew angle $\alpha$ of the crane 10. The zones 422, 424, 426, 428 may be arranged along a vertical direction of the diagram 400, which corresponds to a horizontal or radial direction along which the load radius and limit radii may be indicated.

In one embodiment, as the slew angle changes, the boom model 402 remains fixed on the second working range diagram 400 while the load chart sector models 412, 414, 416, including one or more of the zones 422, 424, 426, 428, 430 scroll left or right within the boundary 401 depending on a direction of slewing movement of the boom 22. Accordingly, as the boom 22 slews in one direction, a portion of one of the adjacent slew sector models 414, 416 scrolls out of the fixed slew range and is no longer displayed on the second working range diagram 400, while new portions of the other adjacent slew sector model may move into the slew range of the second working range diagram 400 to be displayed, or, alternatively, a new slew sector may move into the slew range to be depicted on the second working range diagram 400.

Figure 5:
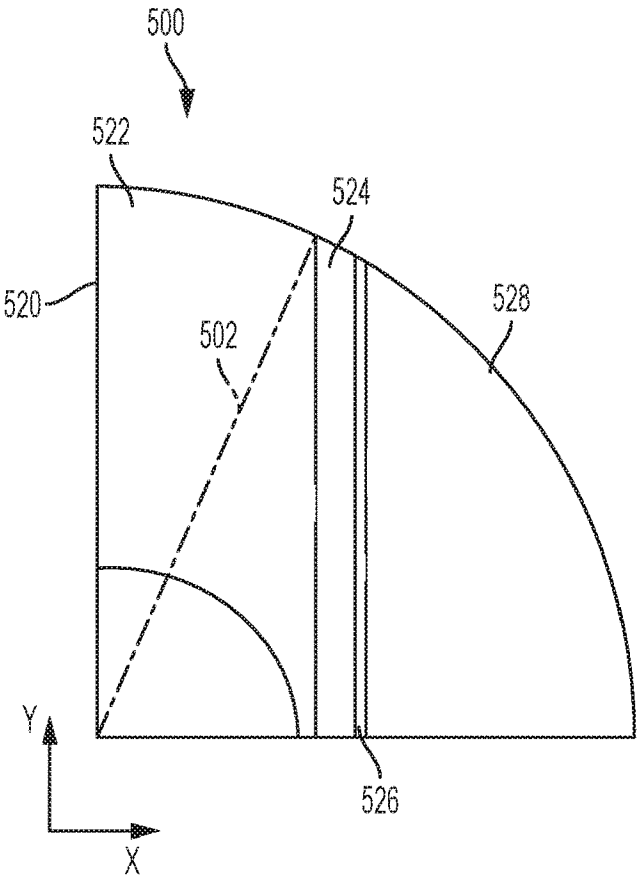
FIG. 5 illustrates a first working range diagram according to another embodiment.

FIG. 5 illustrates another embodiment of a first working range diagram 500. The first working range diagram 500 of FIG. 5 may be substantially the same as the first working range diagram 300 described above with respect to FIG. 3, except that the one or more zones may be based on limit radii corresponding to different load utilizations than those described in the embodiments above. For example, the circular segment 520 may include a first zone 522 extending to a limit radius corresponding to 75% load utilization, a second zone 524 extending from the limit radius corresponding to 75% load utilization to a limit radius corresponding to 90% load utilization, a third zone 526 extending from a limit radius corresponding to 90% load utilization to a limit radius corresponding to 100% load utilization, and a fourth zone 528 extending outward from the limit radius corresponding to the 100% load utilization. The first working range diagram 500 may also include a boom model 502.

With further reference to FIG. 5, the first working range diagram 500 may optionally omit other graphical representations which are provided in the first graphical display 300 of FIG. 3. For example, graphical representations of the load and the lift cylinder may be omitted. Other indicators, such as numerical indicators representative of parameters detected by the sensors may be optionally omitted as well. In addition, the zones 522, 524, 526, 528 may include different color, shading, patterns or like in the manner described above.

Figure 6:
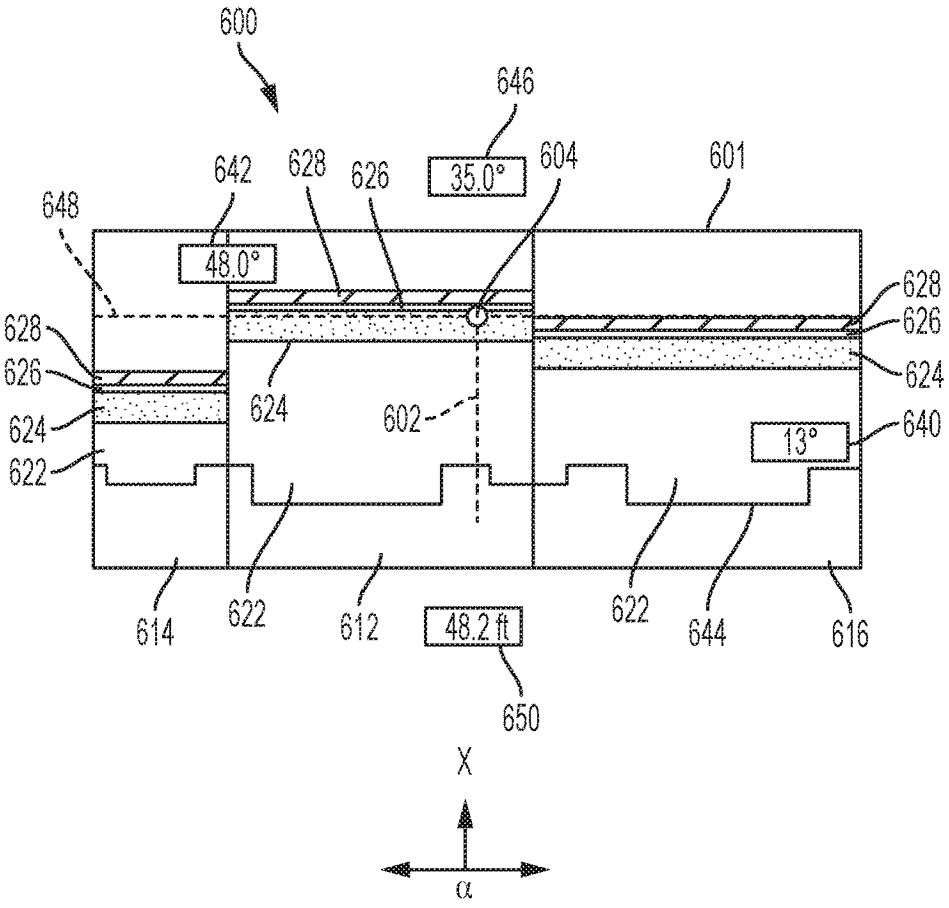
FIG. 6 illustrates a second working range diagram according to another embodiment.

FIG. 6 illustrates another embodiment of a second working range diagram 600.

The second working range diagram 600 may be a scrolling diagram similar to the second working range diagram 400 described above with respect to FIG. 4. However, the second working range display 600 may include additional or different graphical representations.

In one embodiment, the second working range diagram 600 may include a plurality of load chart sector models within a border or boundary 601, including a current load chart sector model 612, a first adjacent load chart sector model 614, and a second adjacent load chart sector model 616, similar to the load chart sector models 412, 414, 416 described above. Each load chart sector model 612, 614, 616 may include one or more zones based on limit radii corresponding to different load utilizations. In one embodiment, the limit radii may correspond to the limit radius described above with reference to FIG. 5.

Accordingly, within each load chart sector model 612, 614, 616, one or more zones 622, 624, 626, 628 may be provided, substantially corresponding to the zones 522, 524, 526, 528 described above.

In one embodiment, each load chart sector model 612, 614, 616 may represent equal slew angle ranges. In one embodiment, however, one or more of the load chart sector models may have a different size, i.e., may be provided at a different scale, than at least one other load chart sector model. For example, the current load chart sector 612 may be enlarged relative to at least one other load chart sector 616 so as to be more easily read by the operator. In one embodiment, an adjacent load chart sector model 616 may be shown at an enlarged scale as well.

In one embodiment, one or more of the sector models of the second working range diagram 600 may also include indicia, such lines or tick marks to indicate a scale of the load chart sector. For example, each sector model could include tick marks spaced apart by 10 degrees. Accordingly, spacing between individual tick marks will be larger in the enlarged load chart sector model(s) than in a non-enlarged or reduced size sector model(s). The tick mark scale may be selected by the operator or may be provided automatically by the crane control system 100.

In one embodiment, the second working range diagram 600 may show only a single load chart sector model. This configuration may be useful, for example, when the crane 10 is set up to have only a single sector model, or when the current load chart sector in which the crane is operating is larger, in terms of slew angle range, than the other load chart sector models.

In another embodiment, the second working range diagram 600 may be configured to show two load chart sector models. For example, the second working range diagram 600 may show the current load chart sector model 612 in which the crane 10 is operating, and an adjacent load chart sector model representing an adjacent load chart sector in the direction of slewing of the crane 10. In another embodiment, three load chart sector models may be shown. For example, a current load chart sector model 612 in which the crane 10 is operating, and adjacent load chart sector models 614, 616 on each side of the current sector model 612 may be shown. The adjacent sector models 614, 616 may represent load chart sectors adjacent to the current load chart sector into which the boom 22 may enter in response clockwise slewing movement and counterclockwise slewing movement.

With further reference to FIG. 6, the second working range diagram 600 may also include an indication of slewing distance 640 to the next load chart sector. For example, in one embodiment, the indication of slewing distance 640 to the next load chart sector may be displayed in degrees, and may further include an indication of a direction of slewing, such as an arrow. In addition, the indication of slewing distance may include a color corresponding to a zone where the current load radius will be positioned in the next load chart sector in the direction of slewing.

Further still, in one embodiment, the second working range diagram 600 may include an indication of a slew angle at which adjacent load chart sectors intersect or abut 642. For example, in one embodiment, such an indication may include an angle, in degrees, where adjacent load chart sectors intersect or abut. The indication of slew angle where adjacent load sectors intersect or abut 642 may include a color corresponding to a zone where in which the current load radius will be positioned in the adjacent load chart sector.

Still referring to FIG. 6, in one embodiment, the second working range diagram 600 may further include a limit radius line or curve 644 indicating a working range limit, for example the 100% load utilization working range limit, throughout an entire slew range of the crane 10, in each of the one or more load chart sector models 612, 614, 616. The limit radius curve 644 is different and shown separately from the zones 622, 624, 626, 628 described above. For example, in one embodiment, with a slew range of 360 degrees, and four 90 degrees sectors, the limit radius curve 644 may indicate the limit radius for 360 degrees in each, individual load chart sector model. Accordingly, an operator may observe a limit radius of the crane 10 across the entire slew range of the crane 10 while focusing on a single load chart sector model, such as the current load sector model 612.

The second working range diagram 600 may also include an indication of the current slew angle 646, a boom model 602 positioned relative to the limit radius curve 644 representing a current slew angle of the boom 22 and a limit radius at that slew angle, for visual alignment purposes, and a graphical representation of the load 604 at a its current load radius, relative to the zones 622, 624, 626, 628. In addition, the second working range diagram 600 may include a line or similar indication of the current load radius 648 extending through one or more of the load adjacent chart sector models 614, 616 so that the operator may visualize a zone in which the current load 604, at the current load radius, would be positioned if moved into an adjacent load chart sector. Further, a numerical indication 650 of the current load radius may be displayed as well. The numerical indication 650 of the current load radius 604 may be displayed as a unit of distance.

Figure 7:
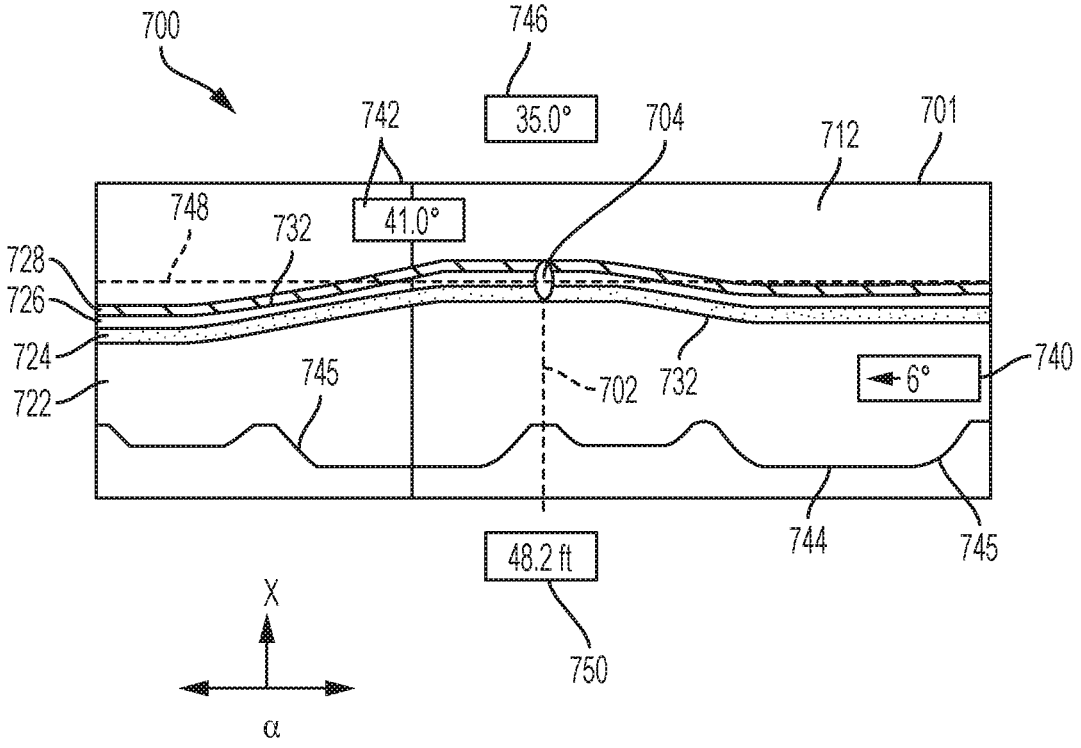
FIG. 7 illustrates a second working range diagram according to another embodiment.

FIG. 7 shows another embodiment of a second working range diagram 700.

The second working range diagram 700 may be a scrolling diagram similar to the second working range diagrams 400, 600 described above. However, the second working range diagram 700 may include additional or different graphical representations.

For example, in one embodiment, the second graphical display 700 may include a load chart sector model 712 that is a continuous representation of one or more load chart sectors, rather than including separate load chart sector models corresponding to different load chart sectors. That is, the second working range diagram 700 may show a single, continuous load chart sector model 712 over a slew angle range in which a plurality of load chart sectors are present. The load chart sector model 712 may be within a border or boundary 701 of the second working range diagram 700.

In one embodiment the second working range diagram 700 may include graphical representations of one or more limit radii over an entire slew angle range, for example, a range of 360 degrees. However, other slew angle ranges are envisioned, including ranges to which slewing movement of the boom 22 may be limited, for example, due to worksite obstacles and the like.

Within the continuous load chart sector model 712, one or more zones, based on the one or more limit radii, may be provided as well. In one embodiment, the one or more limit radii may correspond to the limit radii, and the one or more zones may correspond to the zones 622, 624, 626, 628 described above.

Further still, the second working range diagram 700 may include only a portion of the entire slewing range through which the boom 22 may move. For example, the second working diagram 700 may show a slew angle range of approximately 30 degrees, although the boom 22 may rotate through an entire slew angle range of 360 degrees. In one embodiment, the second working range diagram 700 may show a slew angle range that remains fixed relative to the boom position, but moves within the entire slew range with slewing movement of the boom. Thus, the second working range display 700 may always show, for example, 15 degrees to one side of a boom model 702 in a first slew direction and 15 degrees to another side of the boom model 702 in a second slew direction.

In the second working range diagram 700, load chart information, such as maximum allowed loads and/or a load radius corresponding to each maximum allowed load, may be calculated at each slew angle, portion of slew angle, other desired interval, preferably smaller than the slew angle ranges upon which the load chart sectors above are based. Accordingly, a transition 732 of a limit radius, as the limit radius changes with slew angle, may be displayed as a gradual change on the second working range diagram 700 instead of the step-wise changes shown, for example, in second working range diagram 600 detailed above and shown in FIG. 6.

In one embodiment, the transitions of limit radii may actually be gradual. Thus, the display of a gradual transition may be a reflection of actual conditions. In another embodiment, the displayed gradual transition may be a result of calculations performed at the crane control system 100. For example, an algorithm may be stored in and executed by the crane control system 100 which estimates limit radii for a predetermined range of slew angles. In one embodiment, for example, limit radii may be estimated, for example, by interpolation and/or another algorithm, to provide the gradual transition.

Similar to the second working range diagram 600 described above, the second working range diagram 700 may also include an indication of slew distance 740 to a change in limit radii, for example, in degrees, and may further include an indication of a direction of slewing, such as an arrow. In addition, the indication of slewing distance 740 may also include a color corresponding to a zone where the load radius will be positioned when the boom 22 moves to a slew angle where the limit radius changes.

Further still, in one embodiment, the second working range diagram 700 may include an indication 742 of a slew angle where continued slewing movement will cause a change in the load utilization, and in turn, one or more limit radii. The indication 742 of slew angle may include a color corresponding to a zone where the load radius will be positioned when the load utilization changes. The indication 742 may also include a vertically extending line extending through the zones to provide a visual indication of the slew angle where the load utilization and one or more limit radii are expected to change.

In one embodiment, the second working range diagram 700 further includes the limit radius curve 744 indicating a limit radius throughout an entire slew range of the crane 10, or alternatively, another predetermined slew range. For example, in one embodiment, with a slew range of 360 degrees, the limit radius curve 744 may indicate the working range limit for 360 degrees within the displayed slew range, for example 30 degrees. That is, the second working range diagram 700 may show the various zones and limit radii over, for example, a slew range of 30 degrees. Within this display, the limit radius curve 744 shows a maximum load radius where the current load does not exceed the maximum allowed load, thereby allowing an operator to visualize changes in a maximum working range limit, at slew positions currently outside of the 30 degree displayed range. It is understood that the displayed slew range including the zones may vary, and is not limited to 30 degrees. For example, the displayed slew range may be the entire slew range of the crane 10. It is also understood that the entire slew range may be less than 360 degrees. Transitions 745 of the limit radius shown on the limit radius curve 744 may be shown as gradual, instead of step-wise, transitions as well.

The second working range diagram 700 may also include an indicator for the current slew angle 746, a load model 704 shown at the current load radius and positioned relative to the zones 722, 724, 726, 728 so that an operator may identify a zone in which the load is positioned, and the boom model 702 positioned relative to the limit radius curve 744 to indicate a maximum limit radius, such as the working range limit, at the current slew position of the boom 22. In addition, the second working range diagram may include a line or similar indication of the current load radius 748 extending through the displayed slew range so that the operator may visualize a zone in which the current load, at the current load radius, would be positioned as a result of continued slewing motion of the boom 22 to a slew position where the limit radii change. Further, a numerical indication 750 of the current load radius may be displayed as well.

Figure 8:
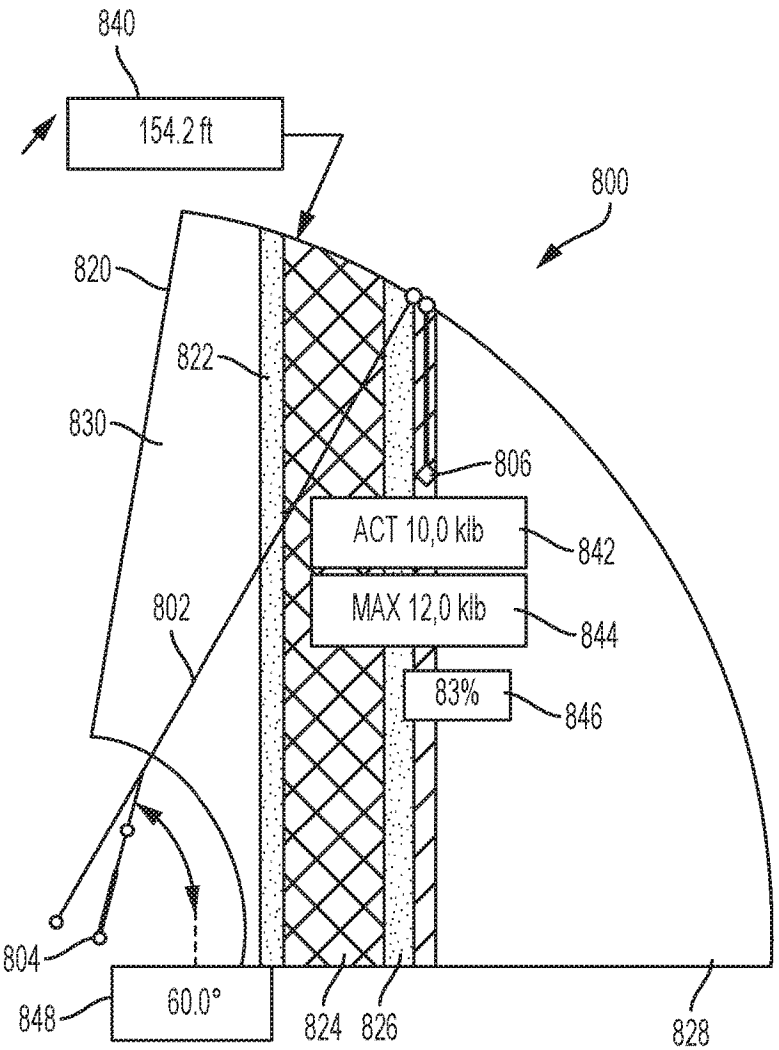
FIG. 8 illustrates a first working range diagram according to another embodiment.

FIG. 8 shows another embodiment of a first working range diagram 800. The first working range diagram 800 is similar to the first working range diagrams 300, 500 described in the embodiments above. For example, the first working range diagram 800 includes a circular segment 820 in which one or more zones are provided based on one or more limit radii. In addition, the first working range diagram 800 may include a boom model 802, a lift cylinder model 804 and load model 806 depicted at a current load radius.

In one embodiment, the first working range diagram 800 includes a first zone 822, second zone 824, third zone 826, fourth zone 828 and fifth zone 830. In on embodiment, first zone 822, second zone 824, third zone 826, fourth zone 828 may substantially correspond to first zone 522, second zone 524, third zone 526, and fourth zone 528 described above. However, it is understood that the first working range diagram 830 is not limited thereto. For example, the first working range diagram 800 may include fewer or additional zones, and/or zones based on limit radii corresponding to different load utilizations.

In one embodiment, the fifth zone 530 is another zone where load utilization also exceeds 100%. The fifth zone 830 may be, for example, a boom-up lockout zone corresponding to a load radius range less than the load radius range of the first zone 822. The fifth zone 830 may be reached by increasing the lifting angle θ to an extent where boom strength is reduced, which in turn, reduces a maximum allowed load. Thus, in one embodiment, the first working range diagram 800 may also include a minimum working range limit.

The first working range diagram 800 may include one or more additional indicators as well. In one embodiment, such indicators may include, but are not limited to, a current boom length indicator 840, a current load indicator 842, a maximum allowed load indicator 844 at the current load radius, a current load utilization indicator 846, a current lift angle indicator 848, or any combination thereof. Other indicators are envisioned as well, including, for example, a current load radius indicator, a working range limit indicator, a current crane configuration indicator, a current slew angle indicator, indicators for other crane parameters, or various combinations thereof. In one embodiment, the indicator may provide a numerical value for each parameter and may be disposed adjacent to the circular segment 820, superimposed on the circular segment 820, or a combination thereof.

Figure 9:
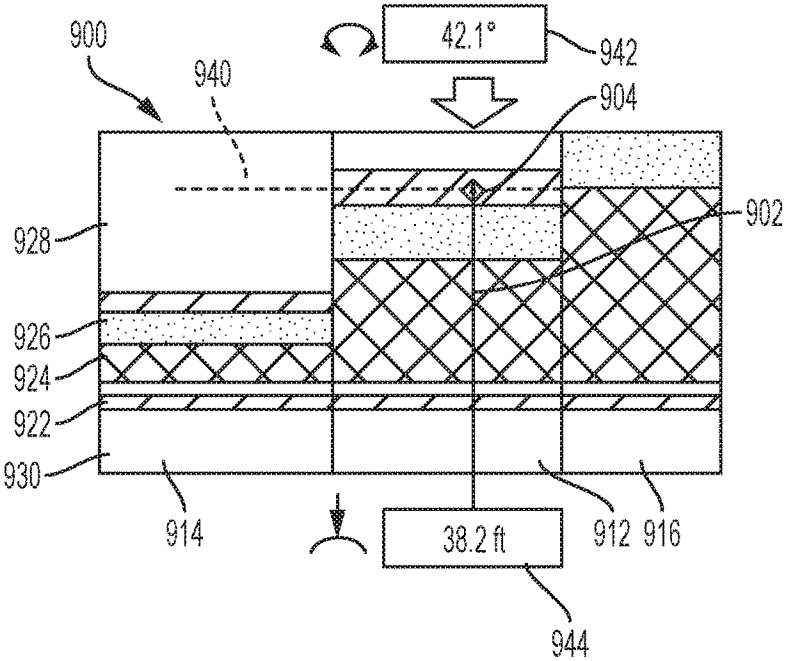
FIG. 9 illustrates a second working range diagram according to another embodiment.

FIG. 9 shows another embodiment of a second working range diagram 900.

The second working range diagram 900 includes some features similar to those described in the second working range diagrams 400, 600, 700 above, further description of which may be omitted here. In one embodiment, the second working range diagram 900 includes a current load sector model 912, and first and second adjacent load sector models 914, 916. Each load sector model 912, 914, 916 includes a plurality of zones based on the limit radii corresponding to different load utilizations. In one embodiment, each load chart sector model 912, 914, 916 includes one or more of a first zone 922, second zone 924, third zone 926, fourth zone 928 and fifth zone 930, which may correspond to the zones 822, 824, 826, 828, 830, respectively, described above.

The second working range diagram 900 may also include a boom model 902 and a load model 906 shown at the current load radius relative to the zones. The second working range diagram 900 may also include one or more additional indicators including, but not limited to, a current load radius graphic indicator 940, a current slew angle indicator 942, and a current load radius indicator 944. In one embodiment, the current slew angle indicator 942 and the current load radius indicator may be numerical indicators. The one or more additional indicators may also include indicators showing a direction movement, for example, a direction of slewing movement or a direction of load radius movement.

Figure 10:
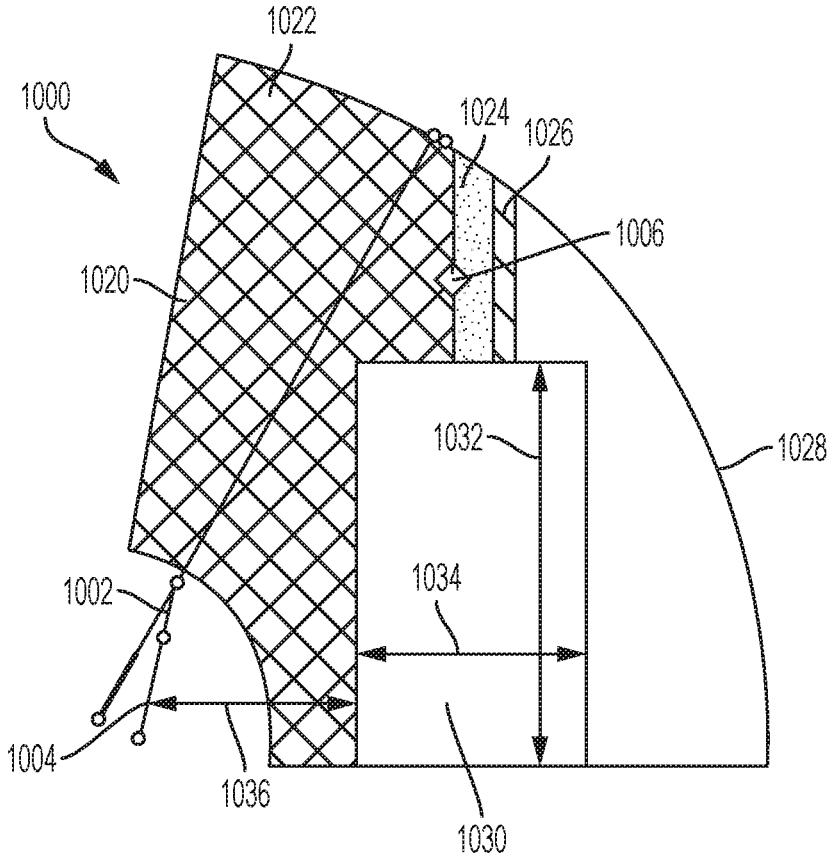
FIG. 10 illustrates a first working range diagram according to another embodiment.

FIG. 10 illustrates another embodiment of a first working range diagram 1000. The first working range diagram 1000 may include some features substantially the same as those described above with respect to the first working range diagrams 300, 500, 800, further description of which may be omitted here. For example, the first working range diagram 1000 includes a circular segment 1020 in which one or more zones are provided based on one or more limit radii. For example, the first working range diagram 1000 may include first zone 1022, second zone 1024, third zone 1026 and fourth zone 1028. In addition, the first working range diagram 1000 may include a boom model 1002, a lift cylinder model 1004 and load model 1006 depicted at a current load radius. The limit radii may be determined in any manner described in the embodiments above.

In addition, the first working range diagram 1000 may include an enhancement for lift planning. For example, the first working range diagram 1000 may include a defined obstacle model 1030 representing an obstacle at a worksite around which a lift is to be planned. In addition, the first working range diagram 1000 may use a specified load input to the system rather than the measured, current load. Thus, if an operator knows the load to be lifted, the operator may input the load into the crane control system 100 to plan the lift operation, rather than planning once the current load is measured.

In one embodiment, the defined obstacle model 1030 may be defined according user parameters such as a height 1032, depth 1034, distance 1036 from the crane, or any combination thereof. The defined obstacle model 1030 provides for a visualization as to whether the crane configuration will be able to perform a lift operation. For example, in the embodiment of FIG. 10, it is readily apparent that the hook will enter the fourth zone 1028 if a load is to be placed toward the far end of the defined obstacle model 1030 or beyond. However, it is readily apparent that the crane 10 will operate in the first zone 1022 when lifting a load to the near side of the defined obstacle model 1030.

In some embodiments, a sensor may measure the distance that the load hangs from the boom 22 such that the placement of the load with respect to the defined obstacle model 1030 may be visualized.

Figure 11:
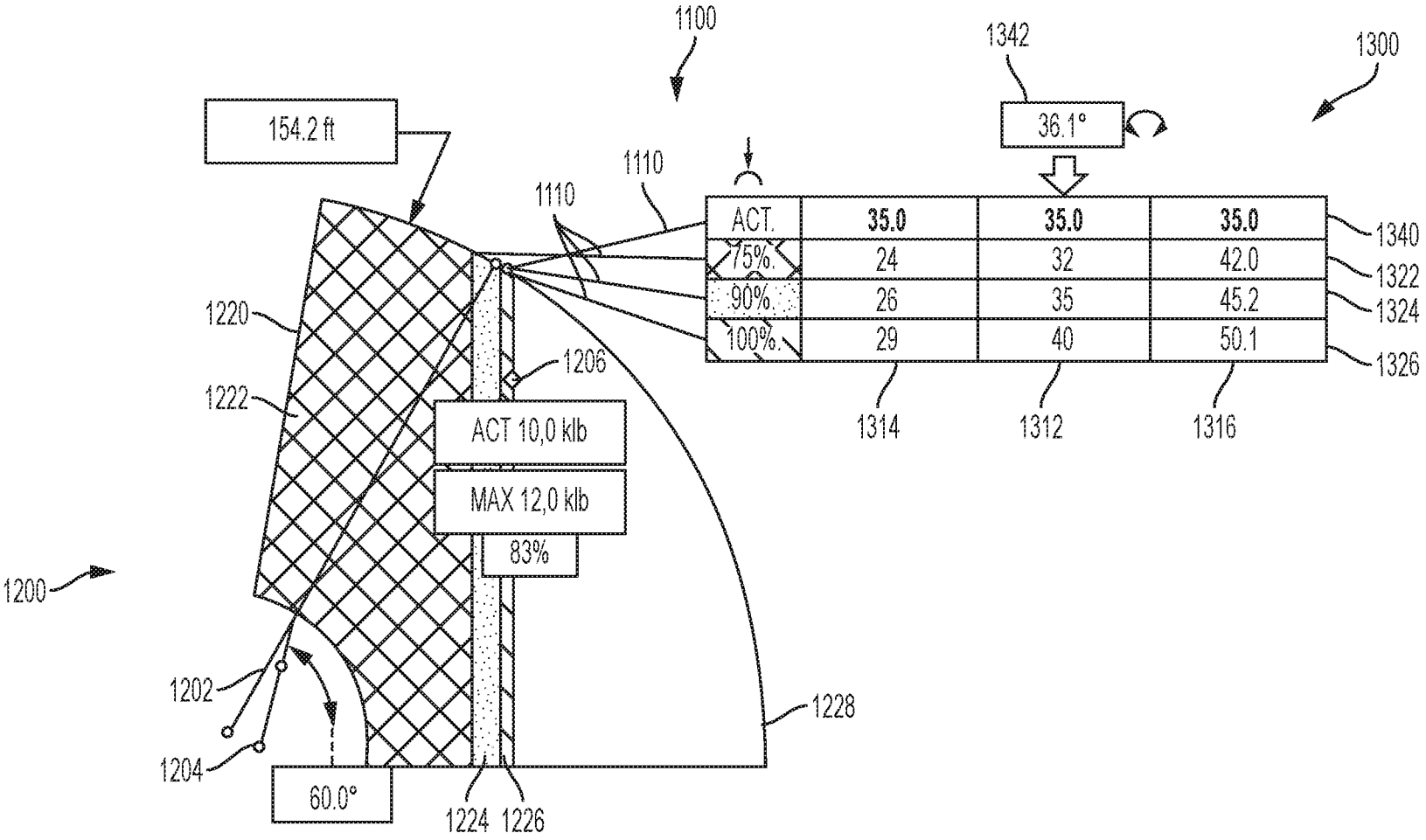
FIG. 11 illustrates a third working range diagram according to an embodiment.

FIG. 11 illustrates an embodiment of a third working range diagram 1100. In one embodiment, the third working range diagram 1100 may include a combination of a first working range diagram 1200 and a second working range diagram 1300. The first working range diagram 1200 may be substantially the same as any of the first working range diagrams described in the embodiments above, and may thus may include, for example, a circular segment 1220, a boom model 1202, a lift cylinder model 1204, a load model 1206, and a plurality of zones 1222, 1224, 1226, 1228 based on limit radii corresponding to different load utilizations. The first working range diagram 1200 may also include various indicators, such as a boom length indicator, current load indicator, maximum allowed load indicator, current load utilization indicator, lift angle indicator, other similar indicators for indicating various crane parameters, or any combination thereof, in the manner described in the embodiments above.

Likewise, the second working range diagram 1300 may be substantially the same as any of the second working range diagrams described in the embodiments above. For example, in one embodiment, the second working range diagram 1300 may include a plurality of load chart sector models 1312, 1314, 1316, and a plurality of zones 1322, 1324, 1325 within each load chart sector based on limit radii corresponding to different load utilizations.

In one embodiment, the second working range diagram 1300 may include numerical limit radius indicators corresponding to different load utilizations within each load chart sector model 1312, 1314, 1316. The second working range diagram 1300 may also include and indicator of a current load radius 1340, for example, a numerical indicator. For example, with reference to FIG. 11, the load chart sector model 1312 may represent a load sector in which the boom 22 is currently position. In the current load chart sector model 1312, limit radii corresponding to 75% load utilization, 90% load utilization, and 100% load utilization are shown as 32 meters (m), 35 m and 40 m, respectively. In addition, in the example illustrated in FIG. 11, the current load radius indicator indicates a current load radius of 35 m. The second working range diagram 1200 may also include various other indicators of different crane parameters, such as, but not limited to, a current slew angle indicator 1342.

In one embodiment, load utilization values depicted in the second working range diagram 1300 may include a color, shading, pattern or the like which correspond to a color, shading, pattern or the like of a correspond zone in the first working range diagram 1200. In addition, the current load radius indicator 1340 may be provided for each load chart sector model 1312, 1314, 1316. Each current load radius indicator 1340 may include a color, shading, pattern or the like which corresponds to the color, shading, pattern or the like of a zone in which such a load radius is, or would be positioned, in the load chart sector. For example, if the first, second, third and fourth zones 1222, 1224, 1226, 1228 include green, yellow, red and black coloring, respectively, the current load radius indicator 1340, indicating a load current load radius of 35 m, may also include black coloring in load chart sector model 1314, red coloring in load chart sector model 1312, and green coloring in load chart sector model 1316.

In one embodiment, the third working range diagram 1100 may also include one or more lines 1110 extending between the first working range diagram 1200 and the second working range diagram 1300, for example, to identify corresponding load utilizations or load radii between the first and second diagrams 1200, 1300. The lines 1110 may also include a color, shading, pattern or the like corresponding to like zones, load utilizations or limit radii.

Figure 12:
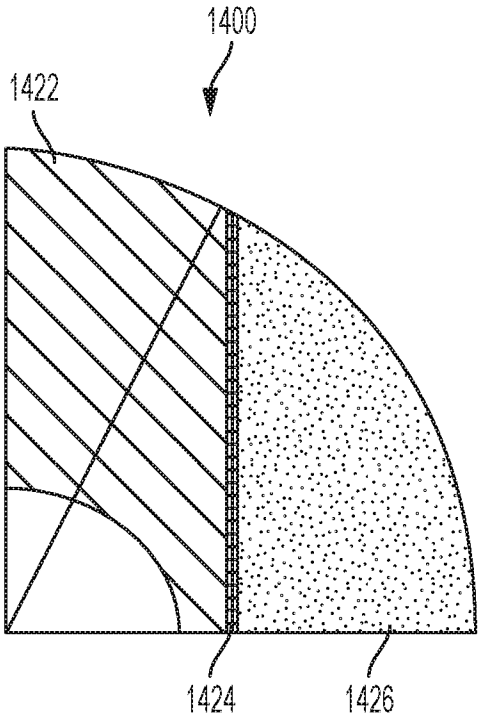
FIG. 12 illustrates a first working range diagram according to another embodiment.

FIG. 12 illustrates another embodiment of the first working range diagram 1400. The first working range diagram 1400 includes a plurality of zones 1422, 1424, 1426 based on limit radii corresponding to different load utilizations as described in the embodiments of first working range diagrams above. Further description features described in the first working range diagrams above may be omitted here.

Figure 13:
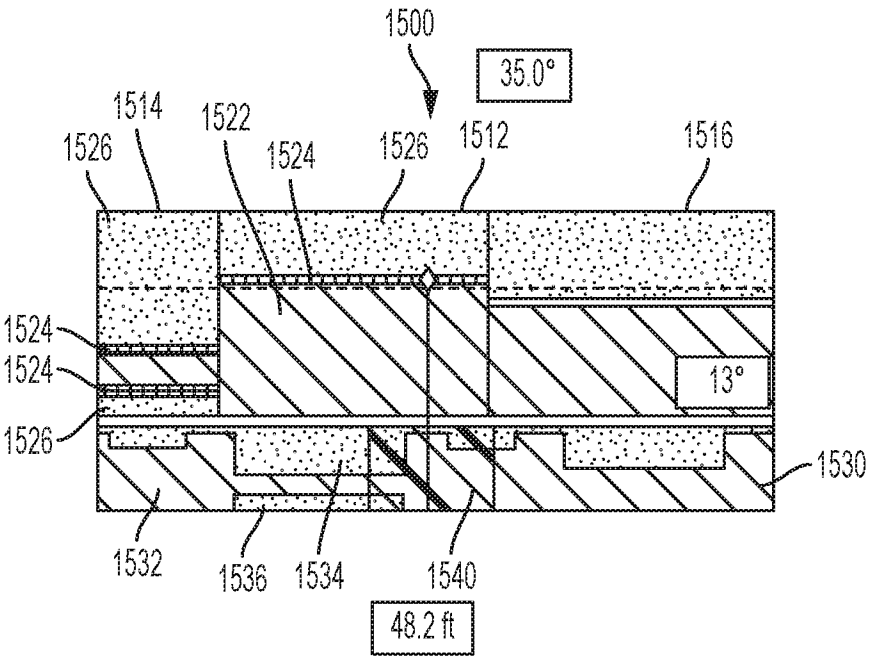
FIG. 13 illustrates a second working range diagram according to another embodiment.

FIG. 13 illustrate another embodiment of the second working range diagram 1500. The second working range diagram 1500 includes a plurality of load chart sector models 1512, 1514, 1516, where load chart sector model 1512 represents a current load chart sector in which the crane is operating and load chart sector models 1514, 1516 represent adjacent load chart sectors. Each load chart sector has a plurality of zones based on limit radii corresponding to different load utilizations in the manner described above. In one embodiment, the zones 1522, 1524, 1526 of the current load chart sector model 1512 correspond to the zones 1422, 1424, 1426 shown in FIG. 12. Further description of features described in embodiments of the second working range diagrams above may be omitted here.

In addition, the second working range diagram 1500 may include a full slew range map 1530 indicating working range limits throughout the entire slew range. For example, in one embodiment, the plurality of load chart sector models 1512, 1514, 1516 may represent only a portion of the full slew range of the crane 10. However, the full slew range map 1530 may provide a representation of the working range limits across the full slew range of the crane, so that an operator may be alerted to changes in working range limits at slew angles falling outside of the range represented by the load chart sector models 1512, 1514, 1516. In one embodiment, the full slew range map 1530 may include a first map zone 1432 indicative of a working range where the load utilization is less than 100%, a second map zone 1534 indicative of a radius which exceeds the maximum working range limit such that the load utilization exceeds 100%, and a third map zone 1536 indicative of a radius which is less than a minimum working range limit such that the load utilization exceeds 100%. The map zones may include different colors, shades, patterns or the like to further visually distinguish the maps zones.

Further still, in some embodiments, within a load chart sector, multiple zones may exist which correspond to the same load utilization. For example, in the adjacent load chart sector model 1514, there may be two zones 1524 based on different limit radii corresponding to the same load utilizations.

In one embodiment, the second working range diagram 1500 may also include view indicator 1540 in the full slew range map 1530, which represents a section of the full slew range map 1430 which is displayed in the load chart sector models 1512, 1514, 1516.

Figure 14:
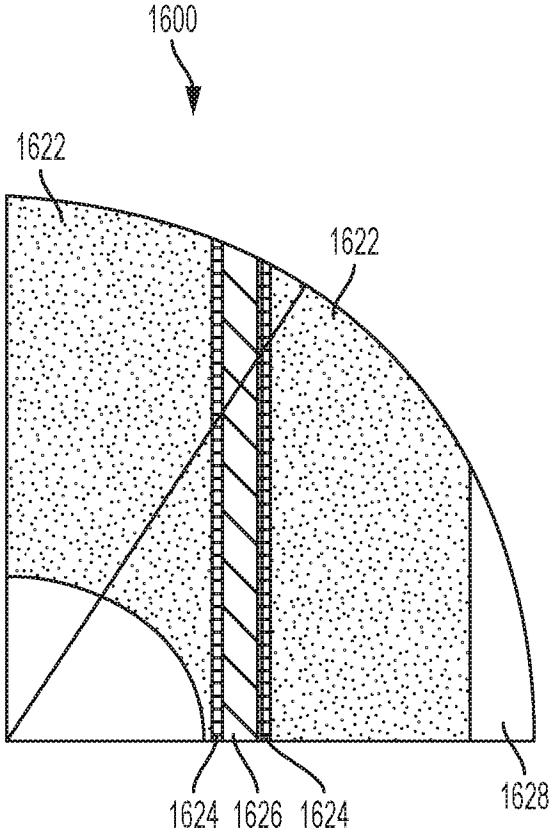
FIG. 14 illustrates a first working range diagram according to another embodiment.

FIG. 14 illustrates another embodiment of a first working range diagram 1600, including a plurality of zones 1622, 1624, 1626, 1628 based on limit radii corresponding to different load utilizations. Discussion of features of the first working range diagram 1600 that are the same as features in embodiments of the first working range diagrams above may be omitted here. As shown in FIG. 14, multiple zones may be provided based on limit radii corresponding to the same load utilizations, such as the first zone 1622 and the second zone 1624.

Figure 15:
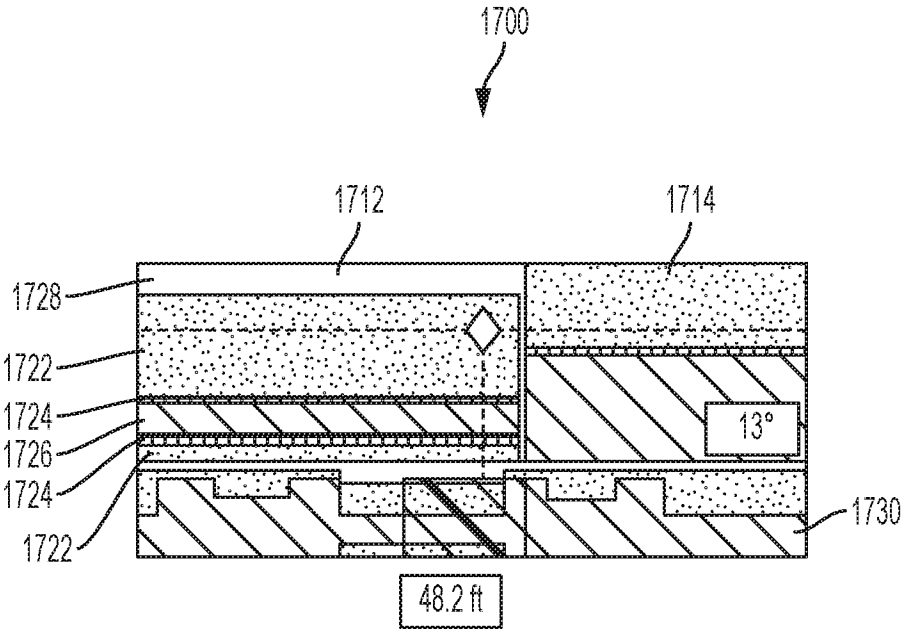
FIG. 15 illustrates a second working range diagram according to another embodiment.

FIG. 15 illustrates another embodiment of the second working range diagram 1700. Discussion of features of the second working range diagram 1700 that are the same as features in embodiments of the second working range diagrams above may be omitted here. In one embodiment, the second working range diagram 1700 includes a current load chart sector model 1712, an adjacent load chart sector model 1714 and a full slew range map 1730. The zones 1722, 1724, 1726, 1728 of the current load chart sector model 1712 correspond to the zones 1622, 1624, 1626, 1628 shown in FIG. 15.

Figure 16:
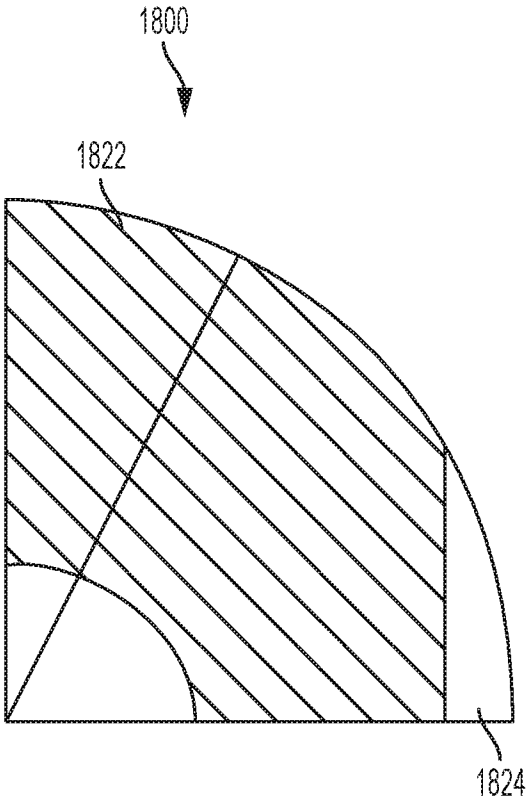
FIG. 16 illustrates a first working range diagram according to another embodiment.

FIG. 16 illustrates another embodiment of the first working range diagram 1800. Discussion of features of the first working range diagram 1800 that are the same as features in embodiments of the first working range diagrams above may be omitted here. In the first working range diagram 1800, a first zone 1822 and a second zone 1824 are provided, based on limit radii for different load utilizations. In one embodiment, the first zone 1822 generally represents a working range in which the crane 10 may freely operate and the second zone 1824 is a zone where crane operation is prohibited.

Figure 17:
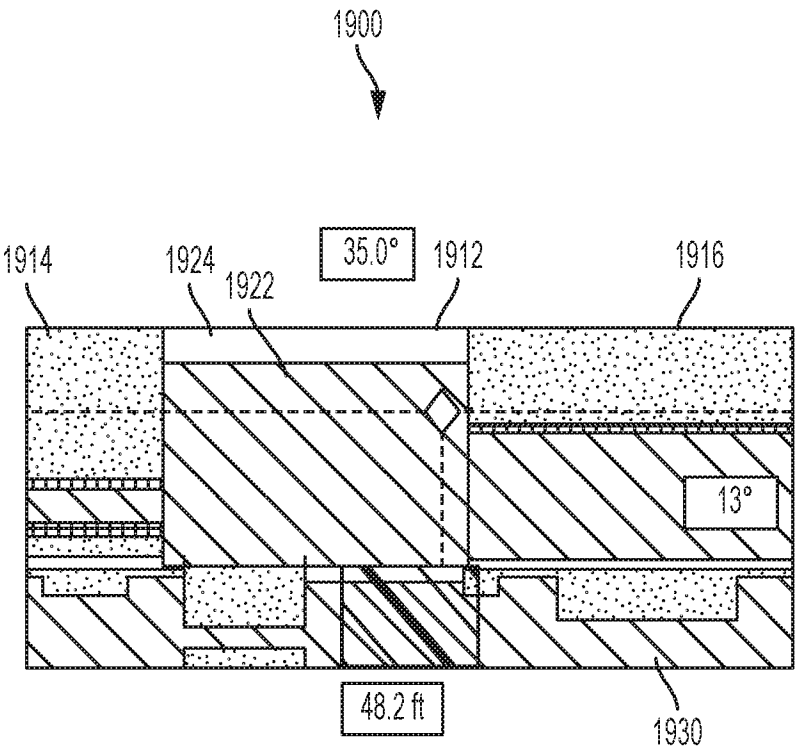
FIG. 17 illustrates a second working range diagram according to another embodiment.

FIG. 17 illustrates another embodiment of the second working range diagram 1900. Discussion of features of the second working range diagram 1900 that are the same as features in embodiments of the second working range diagrams above may be omitted here. The second working range diagram 1900 may include a plurality of load chart sector models 1912, 1914, 1916, each having one or more zones therein. The zones 1922, 1924 in the current load chart sector model 1912 correspond to the zones 1822, 1824 shown in FIG. 16. As can be seen in FIG. 17, the load chart sector models 1912, 1914, 1916 may include different zones and/or a different number of zones than the other load chart sector models 1912, 1914, 1916.

Figure 18:
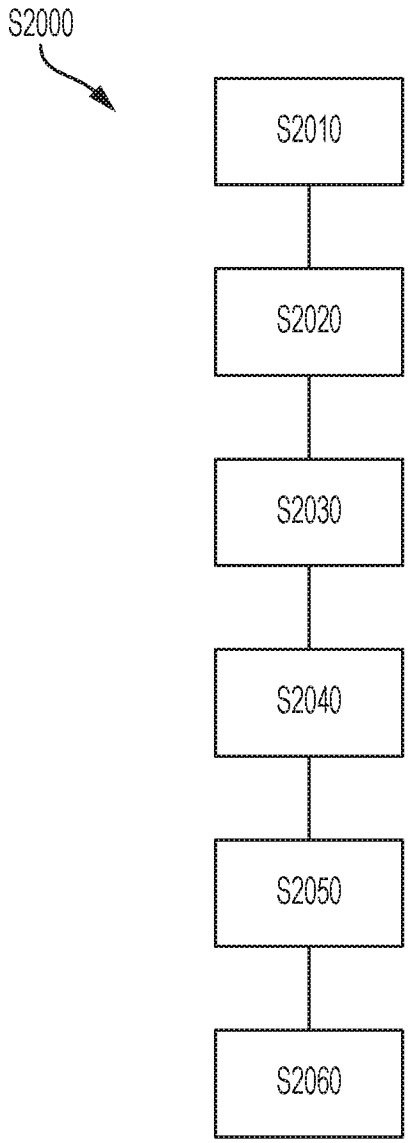
FIG. 18 is a block diagram illustrating a method for generating a working range diagram, according to an embodiment.

FIG. 18 shows a method S2000 of generating a working range diagram according to an embodiment described herein. The method generally includes storing information relating to detected or determined crane parameters S2010. The parameters may be detected by the sensors or determined by the crane control system 100 as detailed above. The information may include, for example, a boom length, a lift angle, a load radius and a current load. The method may also include selecting a load chart S2020 based on the current crane configuration and the current slew angle. The method may further include retrieving a maximum allowed load from the load chart S2030 based on the boom length and load radius information. Current load utilization may be determined based on the current load information and the retrieved maximum allowed load.

The method further includes receiving one or more predetermined load utilizations S2040, and determining a limit radius at the predetermined load utilizations S2050. In one embodiment, the predetermined load utilizations may be input to the crane control system 100 by the operator. For example, the predetermined load utilization values may be determined and input by the operator, or may be stored values in the crane control system 100 which may be selected by the operator. The limit radii may be determined, for example, by calculating a maximum allowed load for a load utilization of the one or more predetermined load utilizations based on the current load, identifying the calculated maximum allowed load on a load chart, and retrieving a load radius from the load chart corresponding to the calculated maximum allowed load. This load radius may then be designated as limit radius corresponding to the load utilization.

In S2060, a working range diagram may be generated including a boom model based on the stored information relating to detected or determine crane parameters, one or more zones based on the determined limit radii corresponding to different load utilizations, and an indication of the current load radius. In one embodiment, an indication of the current load radius may be a numerical indication. In another embodiment, the indication of the load radius may be provided by a load model superimposed on the working range diagram relative to the zones. The working range diagram may be displayed on the display 130.

The method may be carried out by the crane control system 100, for example, by the processor 118. Various information, including the information relating to detected or determined crane parameters, the determined limit radii, and the like, may be stored in the memory 114. Further, additional information, such as colors, shadings, patterns or the like associated with different zones of load utilization values may be stored in the memory 114, and included in the working range diagram in the associated zones.

Further, it is understood that although several specific examples of load utilizations and corresponding limit radii are described in the embodiments above and shown in the figures, that the present disclosure is not limited to these examples. Rather, any load utilization value may be provided by an operator for which a limit radius is to be determined. Further, any number of zones may be provided based on the limit radii, depending on the number of different load utilizations values provided.

It is understood the various features from any of the embodiments above are usable together with the other embodiments described herein. Further, it is understood that same or similar terminology used across the different embodiments above refers to the same or similar component, with the exception of any differences described or shown in the figures. For example, various combinations of limit radii and related zones, as well as coloring, shading, patterns, or the like for the zones, various graphical representations, indicators, or combinations thereof, described in the embodiments above, may be used in the different embodiments described herein In one embodiment, the crane control system 100 is configured to control various crane operations based on the position of the load radius relative to the one or zones described in the embodiments above. For example, the crane control system may control the boom 22 to move, allow for user-operated movement of the boom 22, or prevent movement of the boom 22 based on the position of the load radius relative to the zones, depending on the range represented by the zones. Movements of the boom 22 may include boom-up and boom-down movements (i.e., lifting movements), tele-in and tele-out movements (i.e., boom extension/retraction movements), and swing-left and swing-right (i.e., slewing movements).

The embodiments above may also be used in various lift planning or lift simulations. For example, instead of using the current parameters, an operator may input expected, predicted, or desired parameters to generate a working range diagram which represents working ranges for a planned lifting operation.

In the embodiments above, the use of load charts corresponding to a range of slew angles, i.e., the load chart sectors, reduces a number of calculations performed to determine a maximum allowed load, and likewise, the adjusted maximum allowed load and related limit radii, which may be ultimately based on the adjusted maximum allowed load. Accordingly, the amount of computing power and resources may be reduced relative to a system which may determine the maximum allowed load at every slew angle, or at a portion of every slew angle.

In the embodiments above, any of the first, second or third working range diagrams may be generated by the crane control system 100, output to, and displayed on the display 130. For example, in one embodiment, both the first and second working range diagrams may be displayed on the display 130 simultaneously. Alternatively, the display 130 may be operated so as to toggle between the first and second working range diagrams.

As discussed, the different zones in the working range diagrams may include a color, shading, pattern or the like to more readily distinguish the zones. For example, in one embodiment, the zones may be colored green, yellow, red and black depending on load utilization or other radial distance represented by the zone. For example, a zone corresponding to the lowest load utilization range on the working range diagram may be colored green, while a zone corresponding to the next highest load utilization may be colored yellow. In addition, a zone corresponding to the next highest load utilization may be colored red, and a zone corresponding to range beyond the horizontal extent of the boom 22 at the minimum lift angle may be colored black. For example, in one embodiment, a "green" zone may be a zone in which the boom 22 is freely movable, a "yellow" zone may be a zone in the working range which borders a 100% load utilization limit radius, and a "red" zone may be an overload zone where the load utilization exceeds 100%.

It is understood, however, that that additional or different colors, shading, patterns or the like may be used to represent the zones described above, or to represent additional different or additional zones. It is also understood that fewer zones may be provided in the working range diagrams, and thus, fewer colors, shadings, patterns or the like may be used to represent to the zones.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

The invention claimed is:

1. A crane control system of a crane, the crane comprising a carrier and a superstructure rotatably mounted on the carrier, the superstructure comprising a telescoping boom configured for extension and retraction through a range of boom lengths, rotation through a plurality of slew angle ranges and rotation through a range of lift angles, the crane control system configured to generate a working range diagram for the crane, the crane control system comprising a memory configured to store program instructions and a processor configured to execute the program instructions to:

store first and second predetermined load utilization values;

determine a current load for lifting by the crane;

determine a current boom length;

determine a current lift angle of the boom;

determine a current slew angle range within which the boom is positioned at a current slew angle;

determine a first limit radius for the current slew angle range at which the first predetermined load utilization is reached with the current load, wherein the first limit radius is determined by calculating a first maximum allowed load based on the current load and the first predetermined load utilization, identifying the calculated first maximum allowed load in a stored load chart, identifying a first radius corresponding to the calculated first maximum allowed load in the stored load chart, and designating the first radius as the first limit radius;

determine a second limit radius for the current slew angle range at which the second predetermined load utilization is reached with the current load, wherein the second limit radius is determined by calculating a second maximum allowed load based on the current load and the second predetermined load utilization, identifying the calculated second maximum allowed load in the stored load chart, identifying a second radius corresponding to the calculated second maximum allowed load in the stored load chart, and designating the second radius as the second limit radius;

generate a working range diagram for the current slew angle range comprising:

a boom model representing the current boom length and the current lift angle of the boom;

a plurality of zones based on the first and second limit radii the plurality of zones including a first zone representing a radial distance from the crane to the first limit radius, a second zone representing the radial distance from the first limit radius to the second limit radius, and a third zone representing a radial distance extending beyond the second limit radius; and an indication of a current load radius.

2. The crane control system of claim 1, further comprising a display configured to display the working range diagram.

3. The crane control system of claim 1, wherein each zone of the plurality of zones includes a color, shading or pattern corresponding to a load utilization within the zone.

4. The crane control system of claim 1, wherein the working range diagram further comprises:

a circular segment based on the boom length rotated through a range of lift angles, wherein the plurality of zones are formed within the circular segment and the boom model is superimposed on the circular segment.

5. The crane control system of claim 4, wherein the indication of the current load radius includes a load model superimposed on the circular segment and positioned relative to the plurality of zones.

6. The crane control system of claim 1, wherein the working range diagram further comprises a first load chart sector model representing the current slew angle range and a second load chart model sector representing an adjacent slew angle range, wherein the plurality of zones are provided in each load chart sector model and the boom model is superimposed on a load chart sector model representing the slew angle range in which a crane boom is currently positioned.

7. The crane control system of claim 6, wherein the indication of the load radius includes a load model superimposed on the first load chart sector model and positioned relative to the plurality of zones.

8. The crane control system of claim 6, wherein the plurality first and second load chart sector models represent at least a portion of an entire slew range of the crane, and the working range diagram further includes an indication of at least one limit radius over the entire slew range in each load chart sector model.

9. The crane control system of claim 8, wherein the indication of the at least one limit radius over the entire slew range is a limit radius curve.

10. The crane control system of claim 8, wherein the indication of the at least one limit radius over the entire slew range is a full slew range map having one or more map zones based on the at least one limit radius.

11. A working range diagram for a crane, the crane comprising a carrier and a superstructure rotatably mounted on the carrier, the superstructure comprising a telescoping boom configured for extension and retraction through a range of boom lengths, rotation through a range of slew angles and rotation through a range of lift angles, the working range diagram comprising: a boom model representing a current boom length and a current lift angle of the boom; a plurality of zones based on limit radii corresponding to different predetermined load utilizations, wherein each zone of the plurality of zones represents a radial distance; and a load model representing a current load radius positioned relative to the one or more zones; wherein a first working range diagram includes a circular segment based on a boom length rotated through a range of lift angles, the plurality of zones are formed within the circular segment and the boom model is superimposed on the circular segment, and wherein a second working range diagram includes a plurality of load chart sector models each representing a range of slew angles, the plurality of zones are provided in each load chart sector model and the boom model is superimposed on a load chart sector model representing the slew angle range in which the telescoping boom is currently positioned, wherein the plurality of load chart sector models are movable relative to the boom model with movement of the telescoping boom through the range of slew angles.

12. The working range diagram of claim 11, wherein the predetermined load utilizations include at least a 90% load utilization and a 100% load utilization, and the one or more zones include a first zone representing a working range where the load utilization is less than 90%, a second zone representing a working range where the load utilization is between 90% and 100%, and a third zone representing a working range where the load utilization is greater than 100%.

13. The working range diagram of claim 11, wherein the plurality of load chart sector models represent a portion of an entire slew range of the crane, and the second working range diagram further includes indication of one or more limit radius over the entire slew range.

14. A method of generating a working range diagram for a crane, the crane comprising a carrier and a superstructure rotatably mounted on the carrier, the superstructure comprising a telescoping boom configured for extension and retraction through a range of boom lengths, rotation through a plurality of slew angle ranges and rotation through a range of lift angles, the method comprising: storing information relating to detected or determined crane parameters, the crane parameters including one or more of a current boom length, a current lift angle, a current load, a current slew angle and a current load radius; selecting a load chart based on the current crane configuration and the current slew angle; retrieving a maximum allowed load from the load chart based on the current boom length and the current load radius; receiving one or more predetermined load utilizations; determining limit radii at the predetermined load utilizations within a plurality of slew angle ranges; generating a first working range diagram including a first boom model representing the current boom length and the current lift angle, a circular segment based on the current boom length rotated through a range of lift angles, a plurality of zones based on the limit radii corresponding to different predetermined load utilizations within the circular segment for a slew angle range in which the current slew angle is positioned, and a load model positioned relative to the plurality of zones, the load model representing the current load radius; and generating a second working range diagram including a plurality of load chart sector models each representing a different range of slew angles, each load chart sector model including the plurality of zones based on the limit radii corresponding to the predetermined load utilizations, a second boom model superimposed on a load chart sector model representing the slew angle range in which the current slew angle is positioned, wherein the plurality of load chart sector models are movable relative to the second boom model with movement of the telescoping boom through the range of slew angles.

* * * * *